United States Patent [19]

Uchiyama et al.

[11] Patent Number: 5,048,391

[45] Date of Patent: Sep. 17, 1991

[54] ELECTRONIC MUSICAL INSTRUMENT FOR GENERATING MUSICAL TONES ON THE BASIS OF CHARACTERISTICS OF INPUT WAVEFORM SIGNAL

[75] Inventors: Shigeru Uchiyama, Sayama; Katsuhiko Obata, Tachikawa, both of Japan

[73] Assignee: Casio Computer Co., Ltd., Tokyo, Japan

[21] Appl. No.: 370,336

[22] Filed: Jun. 22, 1989

[30] Foreign Application Priority Data

Jun. 27, 1988 [JP] Japan ..... 63-158752

[51] Int. Cl.[5] ..... G10H 1/057; G10H 1/18

[52] U.S. Cl. ..... 84/654; 84/663; 84/738; 84/742

[58] Field of Search ..... 84/616, 627, 654, 663, 84/681, 702, 703, 738, 742, 454, DIG. 18, 453

[56] References Cited

U.S. PATENT DOCUMENTS

| | | | |
|---|---|---|---|
| 3,911,776 | 10/1975 | Beigel | 84/702 X |
| 4,117,757 | 10/1978 | Akamatu . | |
| 4,291,605 | 9/1981 | Tavel et al. | 84/702 |
| 4,357,852 | 11/1982 | Suenaga | 84/454 X |
| 4,606,255 | 8/1986 | Hayashi et al. . | |
| 4,627,323 | 12/1986 | Gold | 84/616 |
| 4,633,748 | 1/1987 | Takashima et al. . | |
| 4,688,464 | 8/1987 | Gibson et al. . | |
| 4,817,484 | 4/1989 | Iba et al. . | |
| 4,829,872 | 5/1989 | Topic et al. | 84/453 |
| 4,841,827 | 6/1989 | Uchiyama . | |
| 4,895,060 | 1/1990 | Matsumoto . | |
| 4,924,746 | 5/1990 | Obata . | |
| 4,928,563 | 5/1990 | Murata et al. . | |

FOREIGN PATENT DOCUMENTS

| | | |
|---|---|---|
| 55-55398 | 4/1980 | Japan . |
| 55-87196 | 7/1980 | Japan . |
| 55-152597 | 11/1980 | Japan . |
| 55-162132 | 11/1980 | Japan . |
| 55-159495 | 12/1980 | Japan . |
| 57-37074 | 8/1982 | Japan . |
| 57-58672 | 12/1982 | Japan . |
| 61-26090 | 2/1986 | Japan . |
| 61-51793 | 11/1986 | Japan . |
| 62-20871 | 5/1987 | Japan . |
| 62-163099 | 7/1987 | Japan . |

*Primary Examiner*—Stanley J. Witkowski

*Attorney, Agent, or Firm*—Frishauf, Holtz, Goodman & Woodward

[57] ABSTRACT

A vibration of a string is picked up by a pickup to be converted to an electric signal. A pitch extracting circuit obtains pitch data expressing a pitch or a duration of the string vibration from the electric signal. A musical tone generating circuit generates a musical tone having a corresponding tone pitch in accordance with the pitch data. An envelope extracting circuit extracts an envelope from the electric signal detected by the pickup and supplies a signal expressing the envelope to a multiplier. Furthermore, a signal expressing the musical tone is supplied to the multiplier to be multiplied by the signal expressing the envelope. Thus a musical tone having a controlled envelope determined by the extracted envelope is generated.

9 Claims, 22 Drawing Sheets

ELECTRONIC MUSICAL INSTRUMENT FOR GENERATING MUSICAL TONES ON THE BASIS OF CHARACTERISTICS OF INPUT WAVEFORM SIGNAL

BACKGROUND OF THE INVENTION

1. Field of the Invention

The present invention relates to electronic musical instruments of a synthesizer type such as an electronic guitar, other electronic stringed instruments and the like, and more particularly to a technique for an electronic musical instrument for controlling an envelope of a musical tone to be generated.

2. Description of the Related Art

Recently, electronic musical instruments have been developed wherein a vibration of a plucked string is detected as an electric waveform signal, and a musical tone generating circuit comprising digital circuits and/or analog circuits is controlled in accordance with the detected waveform signal, and thereby a musical tone is synthesized and is acoustically generated.

In the other case, the above waveform signal can be electrically detected from a human voice or an acoustic signal generated by playing an acoustic instrument. There are following articles disclosing such a technique:

(a) U.S. Pat. No. 4,117,757 (issued on Oct. 3, 1978), inventor: Akamatsu.

This patent discloses an electronic circuit for forming a waveform signal in which "1" and "0" sequentially inverted at positive and negative peak points of an input waveform signal. This waveform signal is converted to a rectangular wave signal, and its frequency corresponds to a pitch of the input waveform signal.

(b) U.S. Pat. No. 4,606,255 (issued on Aug. 19, 1986), inventor: Hayashi et al.

This patent discloses a guitar synthesizer. A pitch is extracted for each string to obtain a corresponding voltage signal, and a musical tone signal is generated by voltage control.

(c) U.S. Pat. No. 4,644,748 (issued on Jan. 6, 1987), inventor: Takashima et al.

This patent discloses a technique for converting an acoustic signal input through a microphone into a digital signal, and extracting a pitch by digital processing.

(d) U.S. Pat. No. 4,688,464 (issued on Aug. 25, 1987), inventor: Gibson et al.

This patent discloses a technique for extracting a pitch in accordance with time intervals crossing three threshold levels, i.e., high, middle, and low threshold levels of an input waveform signal.

(e) Japanese Patent Publication No. 57-37074 (published on Aug. 7, 1982), applicant: Roland Kabhushiki Kaisha.

(f) Japanese Patent Publication No. 57-58672 (published on Dec. 10, 1982), applicant: Roland Kabushiki Kaisha.

The contents of these two patents correspond to the above-mentioned patent (a), U.S. Pat. No. 4,117,757, and disclose techniques for generating a rectangular wave having a frequency corresponding to a pitch of an input waveform signal.

(g) Japanese Patent Disclosure (Kokai) No. 55-55398 (disclosed on Apl. 23, 1980), applicant: Toshiba Corp.

This patent application discloses a technique for generating a rectangular wave having a frequency corresponding to a pitch of an input waveform signal as in the patent (a), U.S. Pat. No. 4,117,757.

(h) Japanese Patent Disclosure (Kokai) No. 55-87196 (disclosed on July 1, 1980), applicant: Nippon Gakki Seizo Kabushiki Kaisha.

This prior-art invention discloses a technique for generating a fundamental wave pulse having a period corresponding to a pitch in accordance with an output from a pickup of a guitar, counting the pulse by an interval counter to obtain period data, and converting the period data into digital frequency data.

(i) Japanese Patent Disclosure (Kokai) No. 55-159495 (disclosed on Dec. 11, 1980), applicant: Nippon Gakki Seizo Kabushiki Kaisha.

This prior-art invention discloses a technique wherein when an extracted pitch is not varied, a musical tone is started to generate. When two adjacent periods substantially coincide with each other, a coincidence signal is output, and start of tone generation is instructed in accordance with the coincidence signal.

(j) Japanese Utility Model Disclosure (Kokai) No. 55-152597 (disclosed on Nov. 4, 1980), applicant: Nippon Gakki Seizo Kabushiki Kaisha This prior-art device discloses a technique wherein a vibration of a string is extracted by an optical pickup, and the vibration of the string is excited by a pick-up signal to obtain a vibration sustain effect.

(k) Japanese Utility Model Disclosure (Kokai) No. 55-162132 (disclosed on Nov. 20, 1980), applicant: Keio Gikken Kougyo Kabushiki Kaisha.

This prior-art device discloses a technique wherein a detector detects a next zero-cross point of positive and negative peak points of an input waveform signal, and a flip-flop is set/reset in response to each point detection to generate a frequency signal corresponding to a pitch.

(1) Japanese Patent Publication No. 61-51793 (published on Nov. 10, 1986), applicant: Nippon Gakki Seizo Kabushiki Kaisha. This patent is a publication of the invention (h), and has the same gist as the content of the invention (i). That is, digital frequency data is generated upon detection of a substantial coincidence between two adjacent periods.

(m) Japanese Utility Model Publication No. 62-20871 (published on May 27, 1987), applicant: Fuji Roland Kabushiki Kaisha.

This is a Japanese publication corresponding to the invention (b), U.S. Pat. No. 4,606,255.

(n) Japanese Patent Disclosure (Kokai No. 61-26090 (disclosed on Feb. 5, 1986), applicant: Seikou Denshi Kougyo Kabushiki Kaisha.

This prior-art invention discloses a technique for detecting a pitch from an input waveform signal, sequentially writing the detected pitch in a memory, and obtaining accurate pitch data later by executing an arithmetic operation.

(o) Japanese Patent Disclosure (Kokai) No. 62-163099 (disclosed on July 18, 1987), applicant: Fuji Gen Gakki Seizo Kabushiki Kaisha.

This prior-art invention relates to a guitar controller for a guitar synthesizer, wherein frequency changing methods are switched in accordance with monophonic or polyphonic tones generated. More specifically, when a monophonic tone is generated, a picked-up vibration period is continuously reflected to determine the frequency of the musical sound to be generated. When a polyphonic tone is generated, the vibration period is reflected at chromatic scale steps to determine the same.

Furthermore, the following U.S. patent applications disclosing an electronic stringed instrument and a relating electronic equipment thereto associated with the present invention assigned to the present assignee have been filed.

(p) U.S. Ser. No. 112,780 (filed on Oct. 22, 1987), abandoned in favor of Continuation application Ser. No. 07/478,759, filed Feb. 12, 1990 inventor: Uchiyama et al.

This prior-art invention discloses a technique for measuring a time period between positive and negative peak points or between zero-cross points associated with these peak points to extract a pitch of an input waveform signal based on the measured time period, and a technique for performing various control operations in accordance with the obtained pitch.

(q) U.S. Ser. No. 184,099 (filed on Apr. 20, 1988), now U.S. Pat. No. 4,817,484, issued Apr. 4, 1989 inventor: Iba et al.

In this prior-art invention, a musical tone parameter such as a timbre is designated by a fret operation and a picking operation of a string. In order to detect an operated fret, a pitch extraction technique, and a fret switch detection technique is used.

(r) U.S. Ser. No. 256,398 (filed on Oct. 7, 1988), inventor: Iba et al.

This prior-art invention discloses a technique for performing musical tone generation control in units of strings, changing characteristics of an output musical tone in accordance with a plucking strength of a string, or controlling an effector or pan (sound localization).

(s) U.S. Ser. No. 252,914 (filed on Oct. 3, 1988), now U.S. Pat. No. 4,841,827, issued June 12, 1989 inventor: Uchiyama In this prior-art invention, a pitch extraction circuit comprises a digital circuit in place of a conventional analog circuit, and integration of the electronic circuit can be facilitated.

(t) U.S. Ser. No. 256,400 (filed on Oct. 11, 1988), now U.S. Pat. No. 4,895,060, issued Jan. 23, 1990 inventor: Matsumoto This prior-art invention discloses an electronic apparatus for extracting a pitch from an input waveform signal and generating a musical tone having the corresponding tone pitch, and discloses a technique for changing a tone pitch of an output tone along with a change of the input waveform signal in pitch without accompanying an unnecessary variation in interval.

(u) U.S. Ser. No. 282,510 (filed on Dec. 9, 1988), now U.S. Pat. No. 4,924,746, issued May 15, 1990 inventor: Obata In this prior-art invention, even if a pitch is unstably extracted at the beginning of tone generation, a musical tone having a stable pitch can be generated from the beginning. Start of musical tone generation is chromatically instructed on the basis of a pitch extracted by a pitch extraction system.

(v) U.S. Ser. No. 290,981 (filed on Dec. 28, 1988), now U.S. Pat. No. 4,928,563, issued May 29, 1990 inventor: Murata et al.

In this prior-art invention, strings are completely electronically tuned. Before a performance, a reference pitch is determined by plucking at a specific fret, and a tone pitch of a musical tone to be generated is determined on the basis of period data obtained by plucking at a designated fret using the reference pitch.

(w) U.S. Ser. No. 329,418 (filed on Mar. 27, 1989), inventor: Obata

In this prior-art invention, a signal intensity of an input waveform signal at its leading edge and a variation ratio of the signal intensity are detected and tone volume or timbre of a musical tone can be independently controlled in accordance with the two parameters. This technique, for example, in an electronic stringed instrument, allows to change only the timbre of the musical tone without changing its tone volume by shifting a string plucking position.

(x) U.S. Ser. No. 07/362,830 (filed on June 7, 1989) inventor: Katou

In this prior-art invention, characteristics of a musical tone, such as timbre, tone volume, tone pitch and the like are controlled on the basis of variation in a pitch frequency and thereby an abundant performance expression is realized.

As described above, according to the conventional technique, the form of the tone volume envelope of a musical tone to be generated is previously determined by selection of timbre of the musical tone and remains the same. Only the level of the whole tone volume envelope changes depending on the amplitude level of the input waveform signal at the leading edge.

Therefore, for example, even when a guitar operation is performed to abruptly change the envelope of the string vibration of an electronic stringed instrument, the envelope of a musical tone is determined regardless of the above guitar operation. Accordingly, a performance effect desired by the guitar player can not be obtained and the above guitar operation can cause sound offensive to the ear.

When the player plucks a string of an electronic musical instrument, the envelope of the string vibration has a characteristic shown at A in FIG. 1A, and the envelope of the musical tone to be generated has a characteristic shown at B in FIG. 1A. In FIG. 1A, a symbol "ON" indicates a timing at which sound generation of a musical tone is started when the level of the string vibration shown at A in FIG. 1A exceeds a predetermined value. Similarly, a symbol "OFF" indicates a timing at which an instruction to stop sounding is given when the level of the string vibration shown at A in FIG. 1A becomes equal to or less than a predetermined value. That is, the envelope of the musical tone to be generated decreases gradually after the OFF timing.

In this case, when the player performs a muting operation to compulsorily cease the string vibration by holding the string with the palm of his hand, while the string vibration has not adequately decreased after the string is plucked, the envelope of the string vibration shows a characteristic to rapidly decrease right after a strong attack, as shown at C in FIG. 1B. On the other hand, the envelope of the musical tone to be generated keeps an attenuating sound having considerable large volume for a long time even after the OFF timing. Therefore, staccato sounds are not generated and a unique nuance of the muting operation is lost.

SUMMARY OF THE INVENTION

The present invention has been made in consideration of the above situation, and has as its object to provide an electronic musical instrument in which an envelope of a musical tone to be generated can be controlled in accordance with an envelope of an input waveform and thereby a performance effect as expected by a player can be obtained.

That is, according to the present invention, there is provided an electronic musical instrument comprising envelope extraction means for extracting an envelope signal of an input waveform signal, musical tone generation means for generating a musical tone signal, envelope control means for controlling to impart the envelope signal extracted by said envelope extraction means to the musical tone signal generated by said musical tone generation means.

More specifically, the electronic musical instrument of the present invention is realized as an electronic guitar and the like in which a string vibration is detected as an input waveform by a sensor or a pickup and a musical tone is controlled on the basis of the detected input waveform.

The envelope extraction means is preferably realized by a combination of the following means: maximum peak value detection means for detecting a maximum peak value of a digital waveform signal at its leading edge, which signal is obtained by digitizing an input waveform signal, effective peak value detection means for sequentially detecting effective peak values of said digital waveform signal after its leading edge, and envelope signal calculation means for sequentially calculating mean values of an effective peak values sequentially detected by said effective peak value detection means and the previous or preceding effective peak values, for sequentially calculating ratios of the calculated mean value to the maximum peak value detected by said maximum peak value detection means, and for sequentially outputting the ratios as the envelope signal.

The envelope extraction means may be constructed such that said means sequentially calculates ratios of the effective peak values sequentially detected by said effective peak value detection means to the maximum peak value detected by said maximum peak value detection means and sequentially outputs the ratios as the envelope signal.

As the musical tone generation means, various types of means such as a digital sound source means and an analog sound source means can be employed. For example, the musical tone generating means employing digital circuits may be realized by a combination of the following means: memory for storing a digital musical tone waveform, waveform read out means for reading out digital musical tone waveforms from said memory at address intervals corresponding to a sound pitch on the basis of an instruction for starting sound generation and a sound pitch control supplied from a control means, and sound generation means for converting the read-out digital musical tone waveform signal to an analog waveform signal, and for generating sound based on the amplified analog waveform signal. In addition to this, a waveform generation may be effected by employing technique such as a sine wave synthesis, a frequency modulation (FM), a phase modulation and the like.

The envelope control means may be realized by multiplying means which multiplies the musical tone signal generated from the musical tone generation means by the envelope signals sequentially output from the envelope signal calculation means. The envelope control means also may be constructed so as to convert the musical tone signal and the envelope signal to analog signals, respectively and thereafter to perform an analog multiplication.

As described above, according to the present invention, the envelope control means controls the envelope of the musical tone output from the musical tone generation means on the basis of the envelope signal of the input waveform signal extracted by the envelope extraction means. Therefore, an effect of the envelope of the input waveform signal is further imparted to a previously determined peculiar effect of the envelope of the musical tone. In another example, the musical tone generation means outputs a normalized waveform signal having no envelope and the normalized waveform signal is multiplied by the envelope signal supplied from the envelope extraction means. In this manner, the above-mentioned envelope effect may be also obtained.

When the player of, for example, an electronic guitar performs the muting operation to compulsorily cease the string vibration after plucking a string, the envelope of the string vibration abruptly decreases right after a strong attack. Therefore, the envelope of the musical tone generated by the envelope control means also decreases abruptly and thereby the player can change the envelope of the musical tone as the expects by his opera ion of the instrument.

BRIEF DESCRIPTION OF THE DRAWINGS

The above and other objects and features of the present invention will be apparent from the description of the preferred embodiment taken in conjunction with the accompanying drawings, in which.

DETAILED DESCRIPTION OF THE PREFERRED EMBODIMENT

An embodiment of the present invention will now be described in detail.

In the following description, items are classified in the order of underlined captions enclosed in symbols { }, ( ), and < >.

{Arrangement of Electronic Musical Instrument of the Present Invention}

This embodiment is realized as an electronic guitar, wherein six metal strings are kept taut on a body, and a desired string is picked while pressing a fret (finger board) arranged below the metal strings so as to make a performance. Note that its outer appearance will be omitted.

Figure 2:
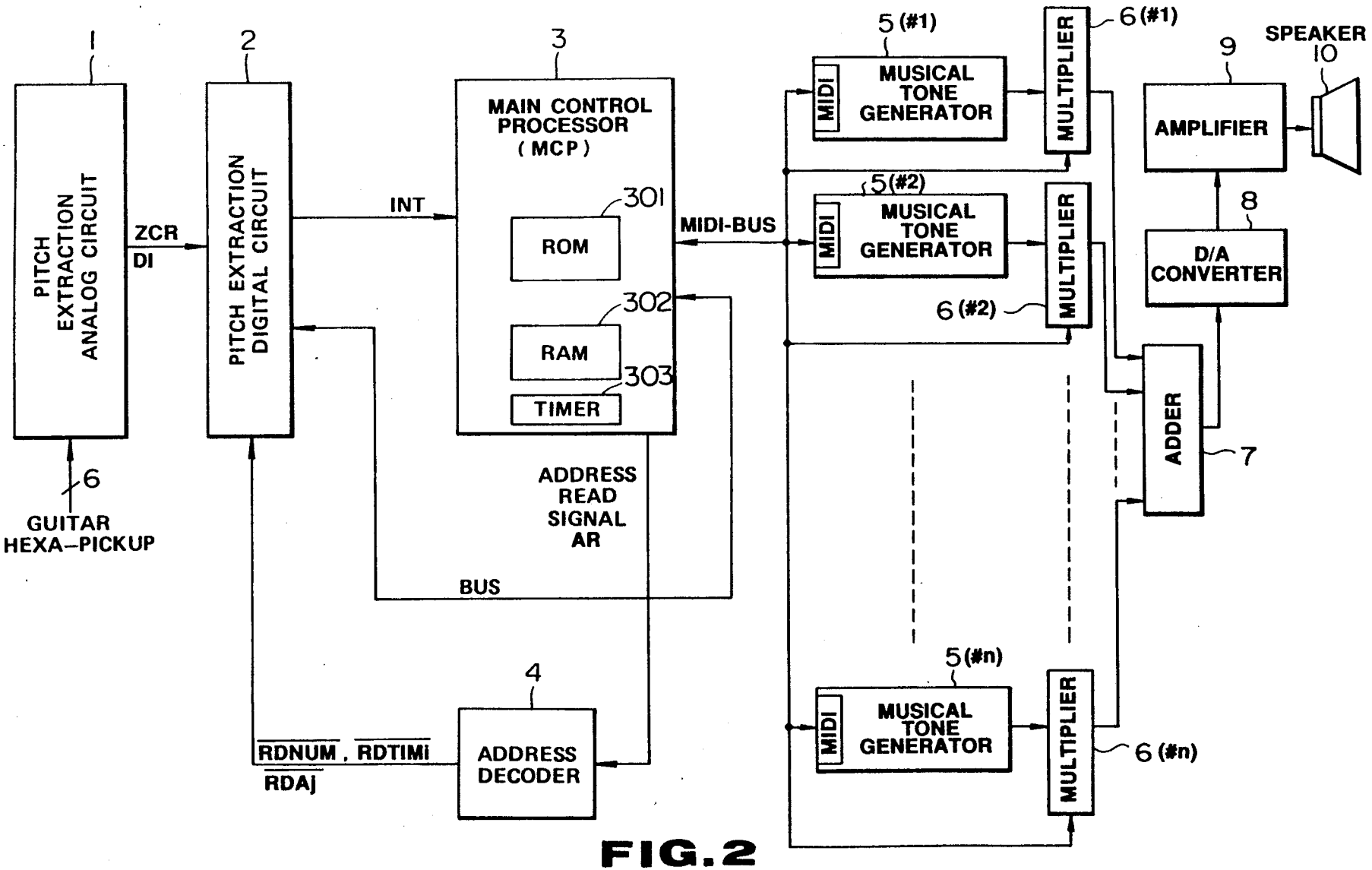
FIG. 2 is a block diagram showing the overall arrangement of an embodiment of the electronic musical instrument according to the present invention.

FIG. 2 is a block diagram showing the overall arrangement of this embodiment.

Pitch extraction analog circuit 1 is connected with each of the six strings (not shown). Hexa-pickups convert vibrations of the corresponding strings into electrical signals. These signals pass through low-pass filters (not shown) to remove harmonic components thereof thereby obtaining 6 waveform signals Wi (i=1 to 6). Furthermore, circuit 1 generates a zero-cross pulse signal Zi (i=1 to 6) which goes H (High) or L (Low) every time the sign of the amplitude of each waveform signal Wi is changed to positive or negative. These 6 waveform signals Wi are converted to a digital output (time-divisional waveform signal) D1 through corresponding A/D converters (not shown) or the like. These 6 zero-cross signals Zi are converted to a time-divisional serial zero-cross signal ZCR. These digital signals are then output.

A pitch extraction digital circuit 2 comprises a peak detector 201, a time constant conversion controller 202, a peak value fatching circuit 203, and a zero-cross time fetching circuit 204. These circuits shown in FIG. 3 time-divisionally process data for the six strings on the basis of the time-divisional serial zero-cross signal ZCR and the digital output D1 corresponding to data of the six strings. In the following description, processing for one string will be described for the sake of easy understanding, and the serial zero-cross signal ZCR and the digital output D1 will be described as signals for one string. However, time-divisional processing for the six strings is performed unless otherwise specified.

Figure 3:
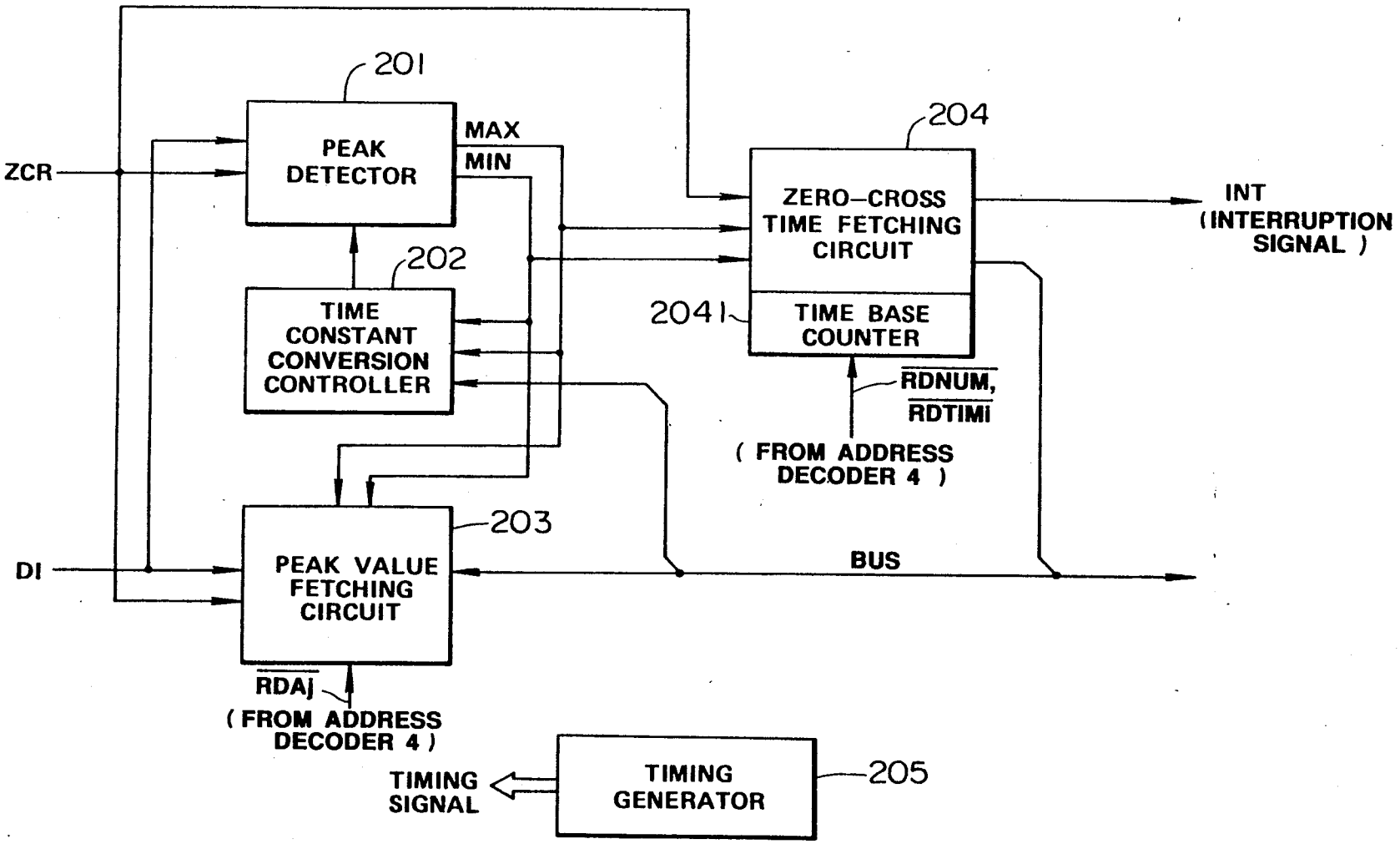
FIG. 3 is a block diagram of a pitch extraction digital circuit in FIG. 2.

In FIG. 3, the peak detector 201 detects maximum and minimum peak points of the digital output D1 on the basis of the serial zero-cross signal ZCR and the digital output D1. Although not shown, the detector 201 includes a peak hold circuit for holding an absolute value of a previous peak value while subtracting (attenuating) it. The peak detector 201 detects a timing of a peak value by using a peak hold signal output from the peak hold circuit as a threshold value. That is, the peak detector 201 detects the after preceding detection of the peak value timing when the absolute value of the digital output D1 exceeds the threshold value after the next serial zero-cross signal ZCR is generated. Note that timing detection of the peak value is executed for positive and negative signs of the digital output D1. At the detection timing of the peak value, the detector 201 outputs a maximum peak value detection signal MAX in the case of positive sign, and outputs a minimum peak value detection signal MIN in the case of the negative sign. Note that these signals are time-divisional signals for the six strings, as a matter of course.

The time constant conversion controller 202 is a circuit for changing an attenuation factor of the peak hold circuit in the peak detector 201, and is operated in accordance with the maximum and minimum peak detection signals MAX and MIN under control of a main control processor (to be referred to as an MCP hereinafter) 3 shown in FIG. 2. This operation will be described later.

The peak value fatching circuit 203 demultiplexes the digital output D1 time-divisionally sent from the peak extraction analog circuits 1 into peak values corresponding to the strings, and holds their peak values in accordance with the peak value detection signals MAX and MIN from the peak detector 201. The circuit 203 sequentially outputs to the MCP 3 through a BUS the maximum or minimum peak value for a string accessed by the MCP 3 (FIG. 2) through an address decoder 4 (FIG. 2). The peak value fetching circuit 203 can output an instantaneous value of a vibration of each string in addition to the peak values.

The zero-cross time fetching circuit 204 latches an output from a time-base counter 2041 common to the strings at a zero cross timing of each string, strictly, at a zero-cross point immediately after a passage timing of the maximum and minimum peak determined by the maximum and minimum peak value detection signals MAX and MIN output from the peak detector 201 in accordance with the serial zero-cross signal ZCR from the pitch extraction analog circuits 1 (FIG. 2). When this latch operation is performed, the zero-cross time fetching circuit 204 outputs an interruption signal INT to the MCP 3 shown in FIG. 2. Thus, the circuit 204 sequentially outputs a number of string of which vibration has been past through a zero-cross point, the latched zero-cross time and positive/negative data corresponding to the string (to be described later) to the MCP 3 through the bus BUS in accordance with a control signal (to be described later) output from the MCP 3 through the address decoder 4 (FIG. 2).

A timing generator 205 shown in FIG. 3 outputs timing signals for processing operations of the circuits shown in FIGS. 2 and 3.

Referring again to FIG. 2, the MCP 3 has memories, e.g., a ROM 301 and a RAM 302, and also has a timer 303. The ROM 301 comprises a nonvolatile memory for storing various musical tone control program (to be described later), and the RAM 302 comprises a re-writable memory used as a work area for various variables and data during control operation. The timer 303 is used for note-off (muting) processing (to be described later). The address decoder 4 shown in FIG. 2 is supplies a string number read signal $\overline{\text{RDNUM}}$ and then a time read signal $\overline{\text{RDTIMi}}$ (i=1 to 6) to the zero-cross time fetching circuit 204 in accordance with an address read signal AR generated by the MCP 3 (FIG. 2) after the interruption signal INT is generated by the zero-cross time fetching circuit 204 (FIG. 3). Similarly, the decoder 4 outputs a waveform read signal RDAj (j=1 to 18) to the peak value fatching circuit 203 (FIG. 3). These operations will be described later in detail.

A musical tone generator 5 (#1 to #n) is provided which an interface (Musical Instrument Digital Interface) MIDI at its input side and is connected to the MCP 3 through a bus MIDI-BUS for transmitting the musical tone control data. Each of the generator 5 can generate one kind musical tone signal and the generator 5 as a whole can generate n kind musical tone signals at the same time.

A multiplier 6 (#1 to #n) is capable of receiving n envelope signals corresponding to each musical tone through the above bus MIDI-BUS or other bus (not shown) and multiplies each musical tone signal output from the musical tone generator 5 (#1 to #n) by the above corresponding envelope signal.

An adder 7 serves to add in a digital fashion n musical tone signals output from the above multiplier 6 (#1 to #n) to obtain one digital signal.

The output signal of the adder 7 is converted to an analog signal by a D/A converter 8, and is amplified by an amplifier 9 and thereafter is acoustically output through a speaker 10.

Note that the above-mentioned operation by n musical tone generators 5 (#1 to #n) and n multipliers (#1 to #n) can be performed in n time-divisional processing by one musical tone generator and one multiplier and thereby n musical tones can be generated. The construction of the time-divisional processing tone generator is will known, and need not to be explained further.

{General Operation of This Embodiment}

The operation of the embodiment with the above arrangement will now be described.

A general operation of this embodiment will be described first.

Figure 1A:
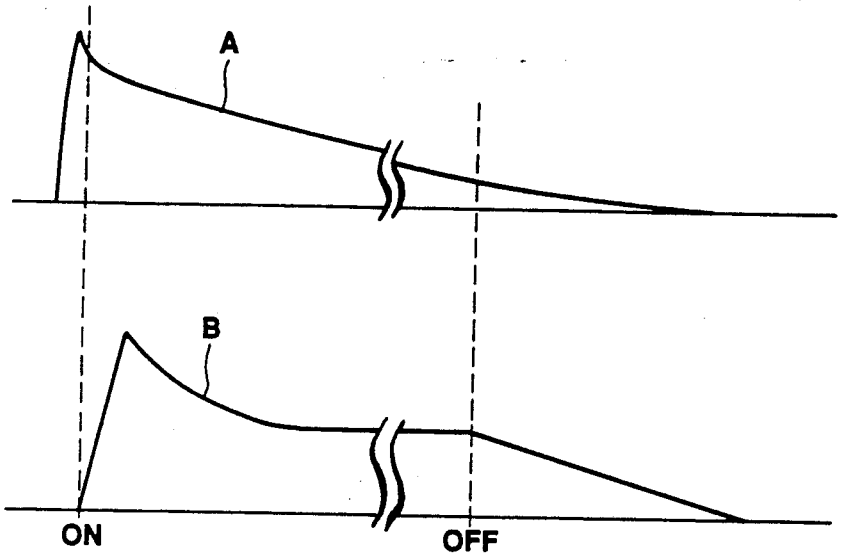
FIG.1A (PRIOR ART)
FIGS. 1A and 1B are charts showing disadvantages of conventional technique.
Figure 1B:
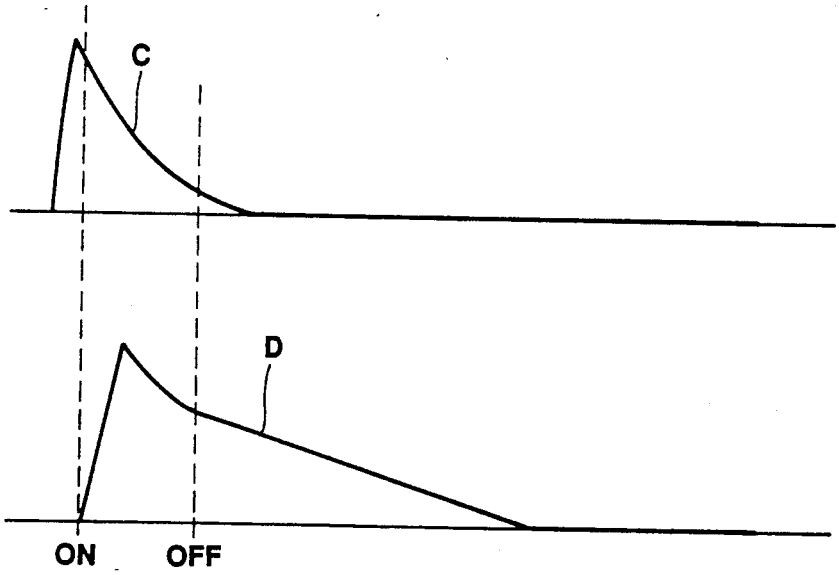
FIG.1B (PRIOR ART)
Figure 11:
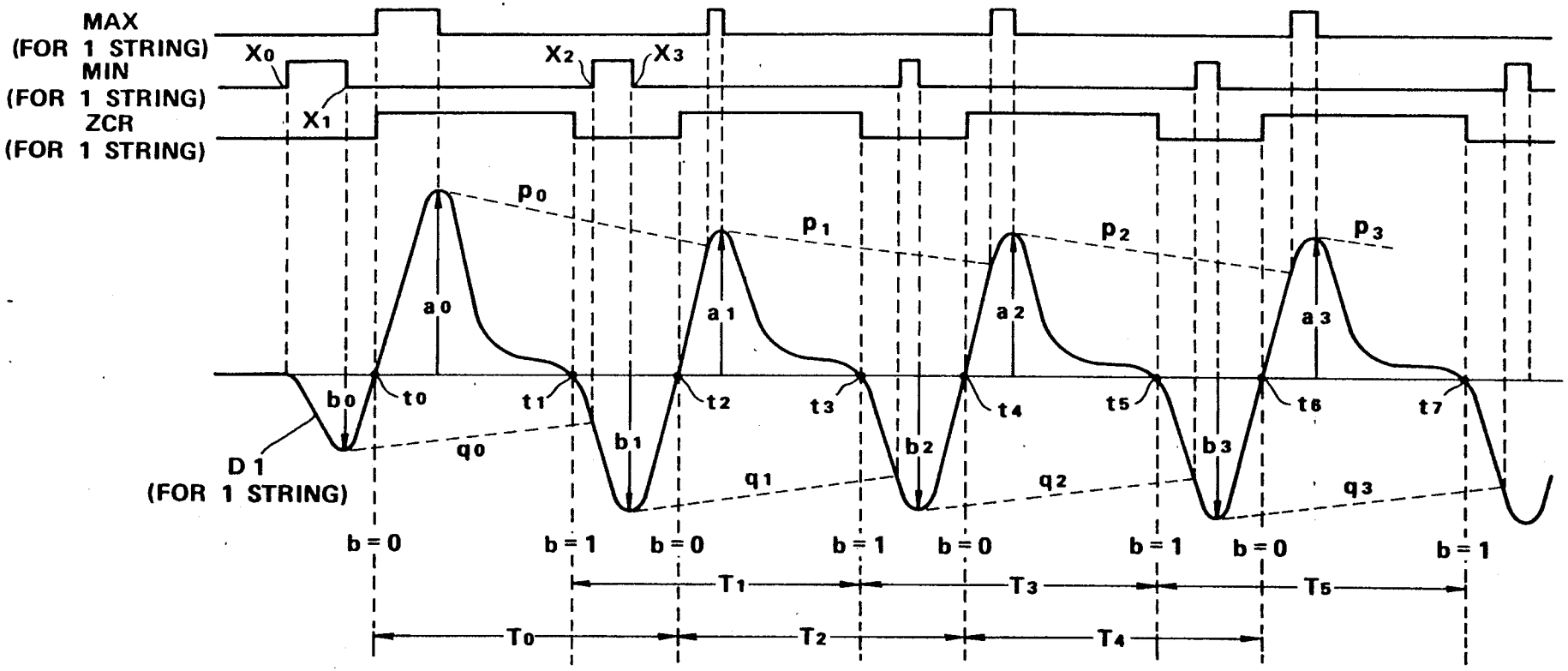
FIG. 11 is a chart for explaining a schematic operation of this embodiment.

A waveform D1 in FIG. 11 represents the digital output D1 for one string output from the pitch extraction analog circuit 1 shown in FIG. 1 in an analog manner. This output waveform signal is a digital signal, which is obtained from an electrical signal detected by the corresponding pickup when one of the six strings of the guitar (not shown) is plucked. The waveform signal has pitch periods indicated by $T_0$ to $T_5$ in FIG. 11 in accordance with a position where the string is pressed on a fret (finger board) (not shown).

In this embodiment, the pitch periods $T_0$ to $T_5$ and the like are extracted in real time, so that the MCP 3 generates corresponding tone pitch data and causes the musical tone generator 501 shown in FIG. 2 to generate a musical tone having the tone pitch. Therefore, when a player changes a tension of the string using a tremolo arm (not shown), the pitch period of the digital output D1 is changed accordingly, and tone pitch data is also changed accordingly. As a result, an abundant expression can be added to a musical tone.

In this embodiment, peak values $a_0$ to $a_3$ or $b_0$ to $b_3$ of the digital output D1 shown in FIG. 11 are detected, and particularly, the MCP 3 of FIG. 2 generates tone volume data based on the maximum peak value $a_0$ at the leading edge (upon plucking a string) and transfers the tone volume data to the musical tone generator 5. Thus, a musical tone having tone volume corresponding to a string plucking strength can be generated.

In a conventional acoustic guitar, when the player performs the muting operation to compulsorily cease the string vibration by holding the string with the palm of his hand while the vibration of the plucked string has not yet decreased adequately, the vibration of the digital output D1 shown in FIG. 11 decreases abruptly. In this embodiment, the MCP 3 in FIG. 2 calculates a mean value of the peak value at each timing and the preceding peak value, i.e., $a_2$ and $b_2$, $b_3$ and $a_2$, $a_3$ and $b_3$ and so on and further calculates ratios of the mean values and the maximum peak value $a_0$. The MCP 3 transfers the calculated ratios to the multiplier 6 (predetermined one of multipliers #1 to #n) in FIG. 2 as the envelope signal. The multiplier 6 multiplies each musical tone data by the received ratios. Thus, variations of the envelope of the digital output D1 can be imparted to the envelope of the musical tone.

Figure 12:
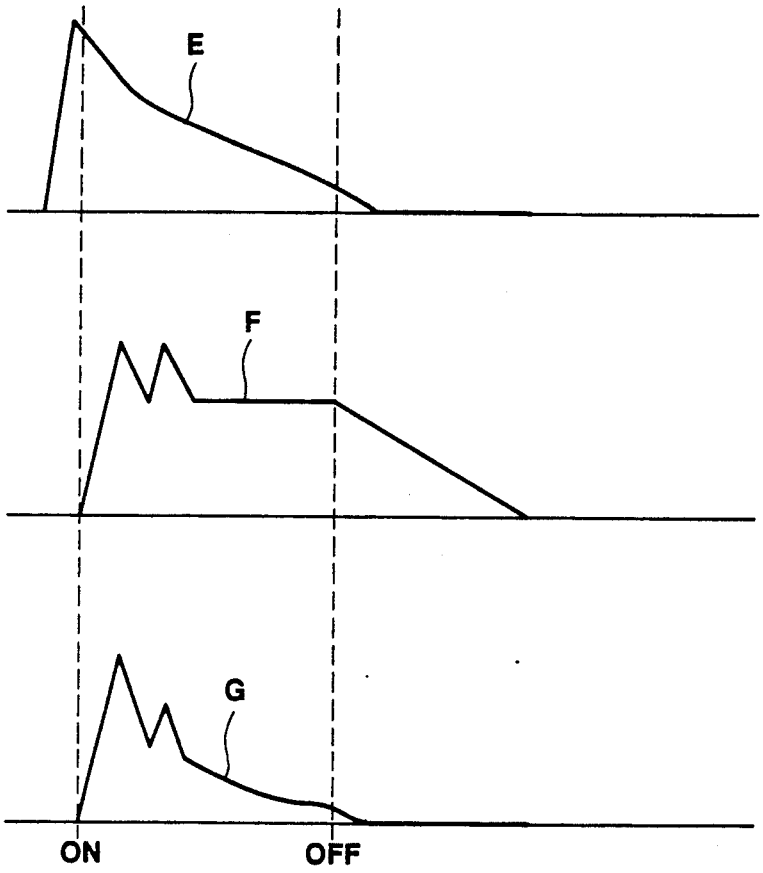
FIG. 12 chart for explaining an operation of this embodiments.

When the player performs the muting operation, the variation of the whole envelope of the digital output D1 is characterized to rapidly decrease as shown at E in FIG. 12. Then, even though the variation of the envelope of the musical tone signal output from the musical tone generator 5 (anyone of generators #1 to #n) has a characteristic as shown at F in FIG. 12, the variation of the envelope of each musical tone output from the multiplier 6 (anyone of multipliers #1 to #n) can be characterized by the tendency to abruptly decrease as shown at G in FIG. 12 in accordance with the variation characteristic of the envelope of the above digital output D1. Thus, the performance effect by the muting operation can be easily obtained.

Since the above-mentioned operation is achieved by time-divisional processing for the time-divisional digital output D1 for the six strings of the guitar, a plurality of the multipliers 6 (#1 to #n) are controlled in parallel to simultaneously and acoustically generate musical tones for the six strings through the speaker 10 in FIG. 2. These musical tones can be set to have desired tone volumes and timbres, and various effects can be electronically imparted thereto. Therefore, a great performance effect can be obtained.

{Operation of Pitch Extraction Digital Circuit}

An operation of this embodiment for realizing the above-mentioned operation will be described in detail below.

(General Operation)

The operation of the pitch extraction digital circuit 2 shown in FIG. 2 or 3 will be described below. The following description will be made for one string, and the serial zero-cross signal ZCR, the digital output D1, and the maximum and minimum peak value detection signals MAX and MIN will be described for one string. However, in practice, time-divisional processing is performed for the six strings.

The circuit 2 extracts the peak values $a_0$ to $a_3$ or $b_0$ to $b_3$, and at the same time, extracts zero-cross times $t_1$ to $t_7$ immediately after the corresponding peak values from the digital output D1 shown in FIG. 11 for each of the strings. Furthermore, the circuit 2 extracts data indicating "1" or "0" in accordance with whether the peak value immediately before the corresponding zero-cross time is negative or positive, and supplies the extracted data to the MCP 3 shown in FIG. 2. Based on these data, the MCP 3 extracts the pitch periods $T_0$ to $T_5$ shown in FIG. 11 from intervals of the zero-cross times, generates various musical tone data described above, and performs error processing, note off (muting) processing, relative-on/off processing, and the like as needed, as will be described later.

(Detailed Operation)

For this purpose, in the peak detector 201 shown in FIG. 3, in response to the digital output D1 input as shown in FIG. 11, the minimum peak value detection signal MIN goes to H level at a timing $x_0$ when the absolute value of the output D1 exceeds 0 in a portion taking a negative value.

In response to this signal, the peak value fetching circuit 203 shown in FIG. 3 detects a minimum peak value (negative peak value) $b_0$ (absolute value) from the separately input digital output D1 at a timing $x_1$ immediately after the minimum peak value detection signal MIN goes to N level, and holds the value in an internal latch (not shown). At the same time, the circuit 203 sets the minimum peak value detection signal MIN at L level.

The serial zero-cross signal ZCR shown in FIG. 11 is input from the pitch extraction analog circuit 1 shown in FIG. 2 to the zero-cross time fatching circuit 204 shown in FIG. 3. This signal is obtained as follows. That is, a comparator (not shown) in the pitch extraction analog circuit 1 determines a positive or negative level of the digital output D1, and outputs an H- or L-level binary digital signal according to the determination result.

The zero-cross time fetching circuit 204 latches time $t_0$ (FIG. 11) counted by the time-base counter 2041 shown in FIG. 3 at an edge timing when the serial zero-cross signal ACR changes immediately after the minimum peak value detection signal MIN output from the peak detector 201 goes to H level at the timing $x_0$ i.e., the zero-cross timing of the digital output D1. Note that a positive/negative flag of "1" or "0" indicating that an immediately preceding peak value is positive or negative (0 for minimum peak value $b_0$) is added to the most significant bit (MSB) of this latch data.

The zero-cross time fetching circuit 204 outputs the interruption signal INT to the MCP 3 shown in FIG. 2 upon completion of the above-mentioned operation. Thus, when the interruption signal INT is generated, the peak value fetching circuit 203 shown in FIG. 3 holds the minimum peak value $b_0$ (absolute value), and the zero-cross time fetching circuit 204 latches zero-cross time including the positive/negative flag immediately after the minimum peak value $b_0$ is generated.

After the interruption signal INT is output, the MCP 3 in FIG. 2 makes access (to be described later) through the address decoder 4, so that the zero-cross time including the positive/negative flag and the minimum peak value $b_0$ are transferred to the MCP 3 through the bus BUS. Note that since the above-mentioned processing is achieved by the time-divisional processing for the six strings, the zero-cross time fetching circuit 204 outputs data indicating an interrupted string number to the MCP 3 before the respective data are output.

In the peak detector 201 shown in FIG. 3, the internal peak hold circuit (not shown) holds the minimum peak value $b_0$ (absolute value) shown in FIG. 11, and outputs a peak hold signal $q_0$ shown in FIG. 11. In response to this signal, the peak detector 201 again sets the minimum peak value detection signal MIN at H level using the peak hold signal (absolute value) as a threshold value at a timing $x_2$ when the absolute value exceeds the threshold value on the negative side of the digital output D1.

The peak value fetching circuit 203 in FIG. 3 holds the next minimum peak value $b_1$ (absolute value) at a timing $x_3$ immediately after the minimum peak value detection signal MIN goes to H level in the same manner as described above. The zero-cross time fetching circuit 204 in FIG. 3 latches zero-cross time $t_2$ including the positive/negative flag (0 in this case) immediately after the minimum peak value $b_1$ is generated. The held value and the latched time are transferred to the MCP 3 after the interruption signal INT is generated.

Detection of the maximum peak values $a_0$ to $a_3$, and the like, detection of zero cross times $t_1$, $t_3$, $t_5$, $t_7$, and the like, and output operations of peak hold signals $p_0$ to $p_3$, and the like on the positive side of the digital output D1 are executed in the same manner as the detection of the minimum peak values $b_0$ to $b_3$ (absolute values), and the like, the zero-cross times $t_0$, $t_2$, $t_4$, $t_6$, and the like, and output operations of the peak hold signals $q_0$ to $q_3$, and the like on the negative side of the digital output D1 shown in FIG. 11. Note that in this case, the peak detector 201 outputs the maximum peak value detection signal MAX, as shown in FIG. 11. The peak value fetching circuit 203 and the zero-cross time fetching circuit 204 shown in FIG. 3 latch the maximum peak values $a_0$ to $a_3$, and the like, and zero cross times $t_1$, $t_3$, $t_5$, $t_7$, and the like including the positive/negative flag (1 in this case because of a positive peak) respectively.

With the above-mentioned operations, the zero-cross time fetching circuit 204 shown in FIG. 3 outputs the interruption signal INT to the MCP 3 shown in FIG. 2 at each of the zero-cross times $t_0$ to $t_7$ shown in FIG. 11, and pairs of minimum or maximum peak values (absolute values) and zero cross times, such as $b_0$ and $t_0$, $a_0$ and $t_1$, $b_1$ and $t_2$, $a_1$ and $t_3$, . . . , are output to the MCP 3 at the corresponding times based on the interruption signal INT. In the MCP 3, determination of the minimum peak value (negative peak value) or maximum peak value (positive peak value) can be performed by the positive/negative flag added to the NSB of the zero-cross time.

In addition to the above-mentioned operation, the peak value fetching circuit 203 can arbitrarily output an instantaneous value of the digital output D1 upon accessing from the MCP 3. This operation will be described later.

The attenuation factor (time constant) of each of the peak hold signals $p_0$ to $p_3$, $q_0$ to $q_3$, and the like shown in FIG. 11 generated by the peak hold circuit in the peak detector 201 in FIG. 3 are changed by the time constant conversion controller 202 in FIG. 3 under control of the MCP 3.

Basically, the time constant is changed so that the peak hold signal is immediately attenuated after one pitch period of the digital output D1 has passed. Pitch period data in this case is set in a time constant conversion register CHTRR (to be described later) in the time constant conversion controller 202 through the bus BUS after the MCP 3 in FIG. 2 extracts the pitch periods as will be described later. Thus, the time constant conversion controller 202 compares the content of an internal counter (not shown) for each string with the pitch period data set in the time constant conversion register CHTRR from the MCP 3. When a coincidence output is generated after the pitch period has passed, the controller 202 sends a time constant change signal to the peak detector 201. With this operation, the peak hold circuit is immediately attenuated after one pitch period has passed, and hence, a peak of the next pitch period can be appropriately detected.

When the next maximum or minimum peak value detection signal MAX or MIN is detected by the peak detector 201 before one pitch period passes, the internal counter is reset in response to the trailing edge of the signal, and the next peak hold signal is generated.

A vibration period of each string is widely changed depending on a position where a player presses the string on the fret. Therefore, at the leading edge of the waveform of the digital output D1 corresponding to each string, in order to quickly detect the vibration of the waveform, the peak hold signal is set to be immediately attenuated in a highest tone period of each string. Immediately thereafter, the peak hold signal is set to be immediately attenuated in an open string period (lowest tone period) of each string so as not to pick up an overtone of each pitch period. After the pitch period is effectively extracted, the peak hold signal is set to be immediately attenuated in the corresponding pitch period so as to follow a change in pitch period of each string of the digital output D1 by the performance operation.

Furthermore, in the pitch detector 201, whether the peak hold control is to be performed for the positive or negative peak value is determined in accordance with the H- or L-level serial zero-cross signal ZCR (FIG. 11).

{Operation of MCP}

With the above operation, the MCP 3 shown in FIG. 2 performs pitch extraction and extraction of parameters associated with a tone volume and a timbre on the basis of the maximum or minimal peak value, the zero-cross time, and the positive/negative flag indicating a positive or negative peak value supplied from the pitch extraction digital circuit 2 shown in FIG. 2, thereby generating musical tone control data for controlling the musical tone generator 5 (generators #1 to #n). Note that the MCP 3 executes the operation flow charts shown in FIGS. 4 to 10 in accordance with the programs stored in the ROM 301, as will be described below.

(Description of Variables)

Variables used in the control programs shown in the operation flow charts of FIGS. 4 to 10 (to be described later) will be described below.

AD:input amplitude value (instantaneous value) obtained by directly reading the input waveform D1 to the pitch extraction digital circuit 2 in FIG. 2

AMP (0, 1):positive or negative old peak value

AMRL1:old amplitude value (peak value) stored in an amplitude register and used for a "relative-off" check. The "relative-off" operation means muting operation on the basis of immediate attenuation of the peak value, and corresponds to muting processing when a fret operation is finished, thereby becoming an open string status.

AMRL2:amplitude value (peak value) before the old amplitude value stored in the amplitude register and used for the relative off operation. The value AMRL1 is input as this value.

CHTIM:period corresponding to a highest tone fret (22nd fret in this embodiment)

CHTIO:period corresponding to an open string fret

CHTR:time constant conversion register arranged in the time constant conversion controller 202 (FIG. 3)

DUB:flag indicating that waveforms in the same direction (positive/negative direction) are successively input FOFR:relative-off counter HNC:waveform number counter MT:flag (positive =1, negative =0) indicating a side for which pitch extraction is to be performed NCHL:no change level (constant)

OFTIM:off time (corresponding to an open string period of the corresponding string)

OFPT:normally off check start flag

ONF:note-on flag

RIV:flag for switching a processing route in STEP 4 (to be described later)

ROFCT:constant for determining the number of times of relative off check

STEP:register (taking a value between 0 to 4 or 5) for designating a flow operation of the MCP 3

TF:valid old zero-cross time data

TFN(0,1):old zero-cross time data immediately after a positive or negative peak value TF:time storing register THLIM:upper limit frequency (constant)

TLLIM:lower limit frequency (constant)

TP(0,1):positive or negative old period data

TRLAB(0,1):positive or negative absolute trigger level (note-on threshold value)

TRLRL:threshold value for relative-on operation (restart of tone generation)

TRLRS:resonance removal threshold value

TTLIM:lower limit frequency upon triggering

TTP:previously extracted period data

TTR:period register

TTU:constant (product of 17/32 and present period data tt)

TTW:constant (product of 31/16 and present period data tt)

VEL:data for determining a velocity, and determined by the maximum peak value of the waveform at the beginning of tone generation (string vibration)

x:flag indicating an abnormal or normal state b:present positive/negative flag stored in a working register b (1 for the next zero point of a positive peak; 0 for the next zero point a negative peak)

c:present peak value stored in a working register C e:peak value before the old peak value, stored in a working register E h:period data extracted in a period before the immediately preceding period, which is stored in a working register H t:present zero-cross time stored in a working register $T_0$ tt:present period data stored in a working register TOTO (Operation of Interruption Processing Routine)

Figure 4:
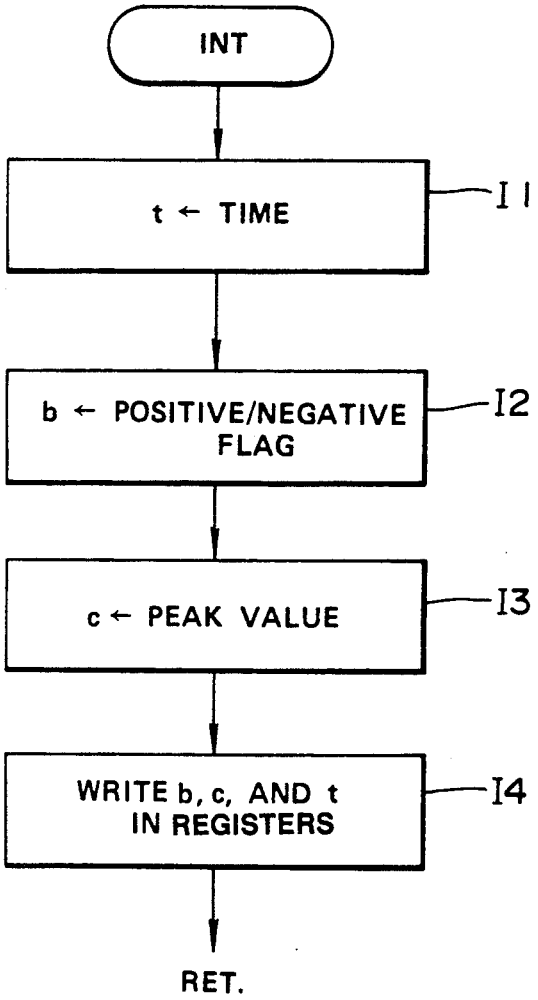
FIG. 4 is an operation flow chart of an interruption processing routine of MCP.

FIG. 4 is an operation flow chart of an interruption processing routine showing a processing to be executed when an interruption is performed in response to the interruption signal INT from the zero-cross time fetching circuit 204 (FIG. 3) in the pitch extraction digital circuit 2.

As described above, when the interruption signal INT is output from the zero-cross time fetching circuit 204, the peak value fetching circuit 203 in FIG. 3 holds the maximum or minimum peak value (absolute value), and the zero-cross time fetching circuit 204 latches the zero-cross time immediately after the corresponding peak value is generated and the positive/negative flag indicating "1" when the immediately preceding peak value is the maximum (positive) peak value and "038 when it is the minimum (negative) peak value.

In step I1 in FIG. 4, the MCP 3 sets a predetermined address read signal AR in the address decoder 4, and causes the zero-cross time fetching circuit 204 in FIG. 3 to output the string number read signal $\overline{\text{RDNUM}}$. The circuit 204 thus outputs, to the MCP 3 through the bus BUS, the string number data indicating a string number for which the interruption occurs. Subsequently, the MCP 3 sets another address read signal AR in the address decoder 4, and causes the zero-cross time fetching circuit 204 to output a signal corresponding to the string number of the time read signals RDTIM1 to RDTIM6. The circuit 204 outputs, to the MCP 3 through the bus BUS, zero-cross time data set in a latch corresponding to the string number by the output time read signal $\overline{RDTIMi}$ (i=1 to 6). This time data is set as the present zero-cross time t, as shown in step I1 in FIG. 4.

In step I2 in FIG. 4, as has been described in Section "Operation of Pitch Extraction Digital Circuit", the positive/negative flag added to the MSB of the zero-cross time data is extracted, and is set as the present positive/negative flag b.

Thereafter, in step I3 in FIG. 4, the MCP3 causes the peak value fetching circuit 203 in FIG. 3 to output a peak value read signal $\overline{RDAj}$ (j=1 to 12) through the address decoder 4 in the same manner as described above. Note that since the circuit 203 includes 12 latches (not shown) for holding maximum and minimum peak values for the six strings, the MCP 3 causes the address decoder 4 to selectively output the peak value read signal $\overline{RDAj}$ on the basis of the string number and the positive/negative flag b. Thus, the maximum or minimum peak value (absolute value) set in the latch designated by the peak value read signal $\overline{RDAj}$ is output from the circuit 203 to the MCP 3 through the bus BUS. This peak value is set as the present peak value c, as shown in step I3 in FIG. 4.

After the above operations, in step I4 in FIG. 4, the values t,c, and b obtained as described above are set in registers $T_0$, C, and B (not shown). Every time the interruption processing is executed, a set of the zero cross time data, the peak value data (absolute value), and the positive/negative flag data indicating the peak polarity is set in these registers. In a main routine (to be described later), processing for data associated with each string is performed.

The registers T0, C, and B are arranged six each in correspondence with the six strings. The MCP 3 in FIG. 2 keeps data at its RAM 302, which data indicates for which string each musical tone generators (#1 to #n) and each multiplier 6 (#1 to #n) are executing a sounding operation and an envelope control operation. Musical tone control processing and envelope control processing to be described with reference to FIGS. 5 to 10 are time-divisionally performed for six strings. The MCP 3 executes processing for the musical tone generator 5 and multiplier 6 corresponding to the above registers T0, C, and B which correspond to a string to which the interruption occurs. Hereinafter, unless otherwise specified, the above operation is executed.

(Operation of Main Routine)

Figure 5:
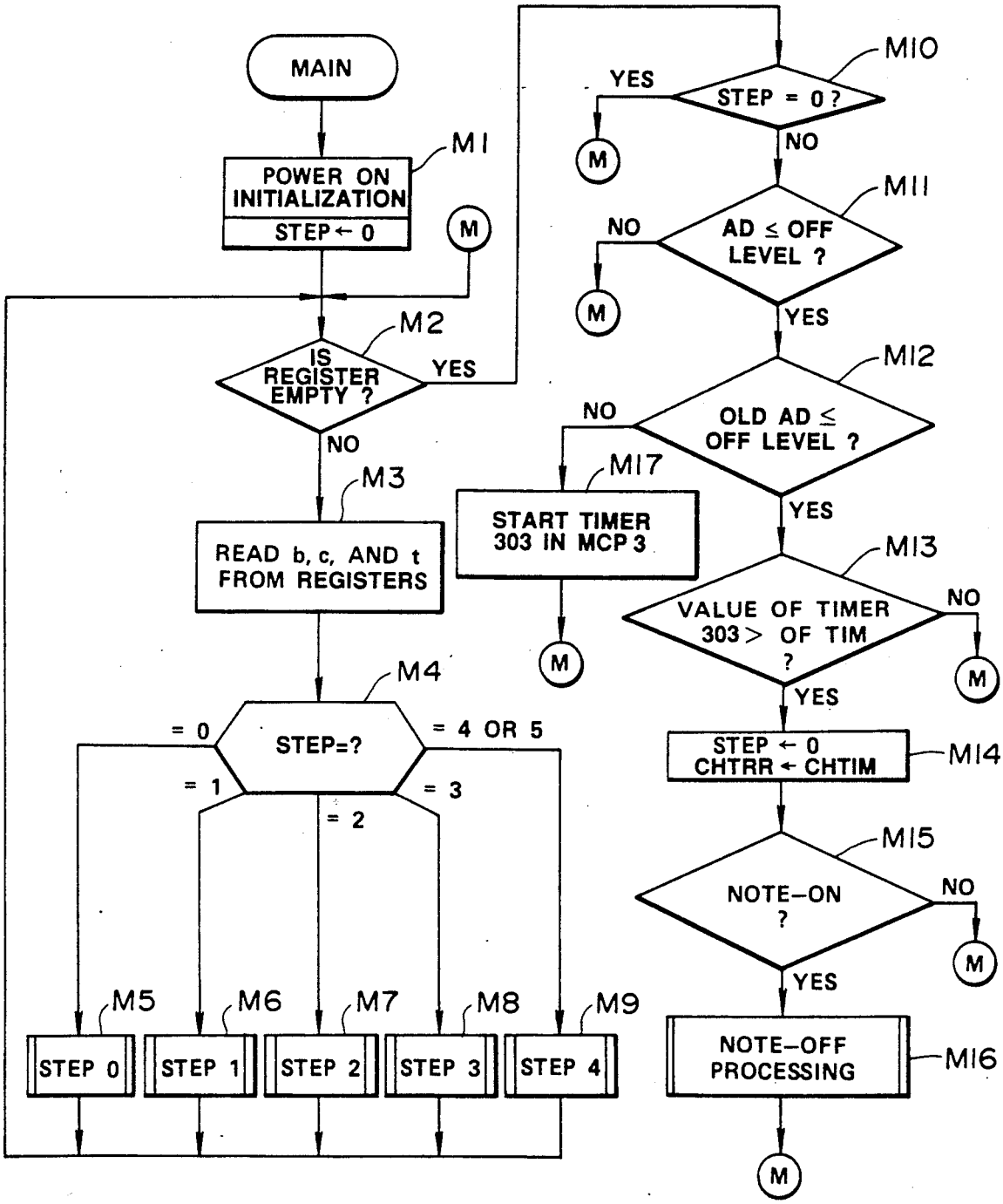
FIG. 5 is an operation flow chart of a main routine of MCP.

FIG. 5 is an operation flow chart showing main routine processing. In this routine, initialization after power-on, note-off (muting) processing of a musical tone, and selection processing of operations of STEP 0 to STEP 4 (or 5) are performed. In this embodiment, as will be described later, musical tone control processing is performed according to the processing concept named "STEP", that is, musical tone control is performed in the order of STEP 0→STEP 1→STEP 2→STEP 3→STEP 4 (→STEP 5)→STEP 0, as will be described later.

<Basic Operation>

In FIG. 5, when a power switch is turned on, various registers and flags are initialized in step Ml, and the register STEP is set to be "0". In this case, a has been described in the description of the time constant conversion controller 202 (FIG. 3) in Section "Operation of Pitch Extraction Digital Circuit", the MCP 3 sets the highest tone fret period CHTIM in the time constant conversion register CHTRR in the time constant conversion controller 202 through the bus BUS, so that the peak detector 201 (FIG. 3) can quickly detect a vibration at the leading edge of the waveform of the digital output D1. Thus, control is performed so that the peak hold signal ($p_0$ or $q_0$ in FIG. 11) output from the peak hold circuit in the peak detector 201 is immediately attenuated in the highest tone period time.

Subsequently, in step M2 in FIG. 5, it is checked if the register described in Section -Operation of Interruption Processing Routine- is empty. If NO in step M2, the flow advances to step M3, and the contents of the registers B, C, and T0 are read. In step M4, the value of the register STEP is checked. Processing operations of STEP 0, STEP 1, STEP 2, STEP 3, and STEP 4 are sequentially executed in steps M5, M6, M7, M8, and M9. Note that updating to the next STEP is performed in the processing of STEP 0 to STEP 4, as will be described later.

<Note-Of Operation>

If it is determined in step M2 that the register is empty, i.e., YES in step M2, the control advances to processing in steps M10 to M16. In these steps, normal note-off algorithm processing is performed. In this note-off algorithm, if a state wherein the peak value of the digital output D1 (FIG. 2) is equal to or smaller than an OFF level is continued for a predetermined off time, a note-off operation is performed.

It is checked in step M10 if STEP =0. If YES in step M10, the note-off operation need not be performed since a initial state wherein no musical tone is generated is detected. Thus, the flow returns to step M2. If NO in step N10 the flow advances to step M11.

In step M11, the input peak value (instantaneous value) AD of digital output D1 at that time is directly read. This can be achieved as follows. The MCP 3 supplies one of the peak value read signals RDA13 to RDA18 to the peak value fetching circuit 203 (FIG. 3) through the address decoder 4, so that the circuit 203 outputs the present instantaneous value of the digital output D1 to the MCP 3 through the bus BUS. It is then checked if this value AD is equal to or smaller than a preset OFF level. If NO in step M11, the flow returns to step M2 since the note-off operation need not be performed. However, if YES in step M11, the flow advances to step M12.

It is checked in step M12 if the old input peak value AD is equal to or smaller than the OFF level. If NO in step M12, the flow advances to step M17, and the timer 303 in the MCP 3 is started. The flow then returns to step M2. When the control comes again to this processing, since YES is obtained in step M12, the flow advances to step M13 to check if the value of the timer 303 is equal to the off time OFTIM. As the off time OFTIM, the open string fret period CHTIO of a string subjected to processing is set. If NO in step M13, the flow returns to step M2 to repeat the above-mentioned processing. If YES in step M13, the flow advances to step M14, and data "0" is written in the register STEP and the highest tone fret period CHTIM is set in the time constant conversion register CHTRR. Thereafter, the flow advances to step M16 via step M15 (to be described later). More specifically, when the level of the digital output D1 becomes attenuated, if the input peak value AD equal to or smaller than the OFF level is kept unchanged for a time period corresponding to the off time OFTIM, it can be determined that no digital output D1 is input and a plucking operation of a string is stopped. Thus, the flow then advances to step M16, and note-off processing is performed.

In step M16, the MCP 3 sends a note-off instruction to the musical tone generator 5 (any one of #1 to #5) (FIG. 2), thus stopping generation of a musical tone. In this manner, when the note-off processing is performed, the flow must return to STEP 0.

In a normal state, YES is obtained in step M15. However, with processing to be described below, the register STEP may take a value other than 0 even when a generation instruction of a musical tone is not performed (caused by, e.g., a noise input). In this case, the flow returns to step M2 after the processing in steps M14 and M15, so that the register STEP can be initialized to STEP 0.

(Processing Operation in STEP 0)

Each routine branching from the main routine shown in FIG. 5 and performing the corresponding processing will be described below.

Figure 6:
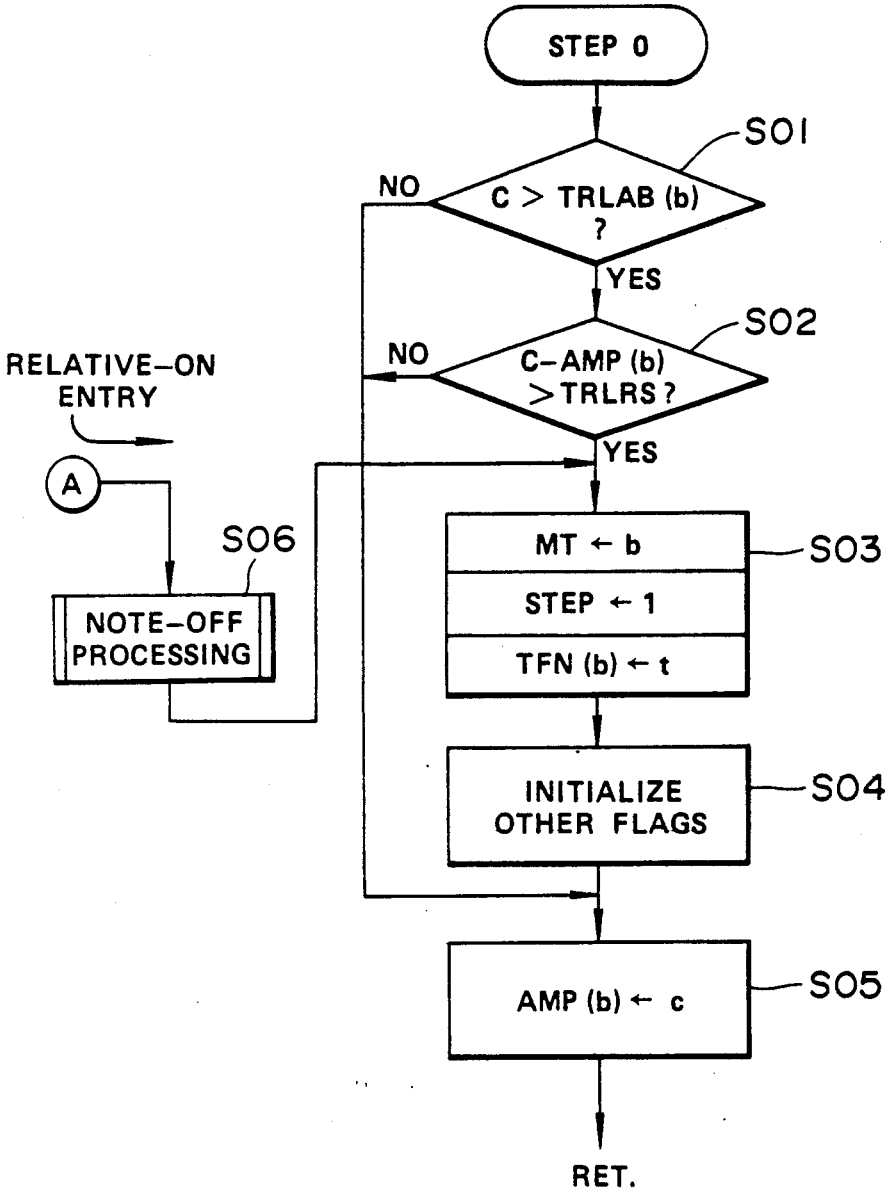
FIG. 6 is an operation flow chart of processing STEP 0 shown in FIG. 5.
Figure 13:
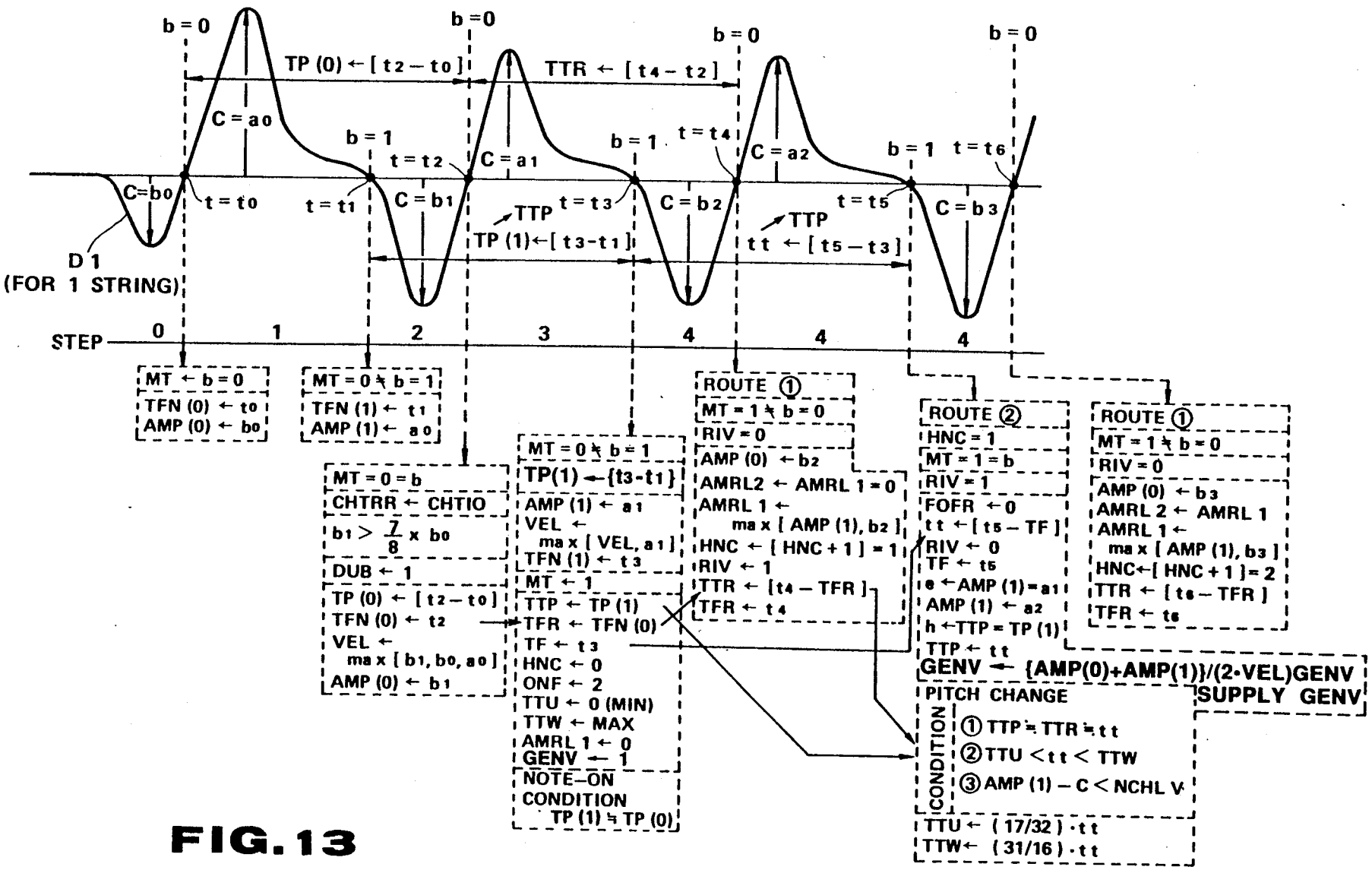
FIG. 13 is a chart for explaining a basic operation of this embodiment.

FIG. 6 is an operation flow chart of processing in STEP 0 as step M5 in the main routine shown in FIG. 5. In this processing, initialization for pitch extraction processing, and the like, and transition processing to next STEP 1 are performed. A description will be made with reference to the chart of FIG. 13 for explaining the basic operation. Note that a waveform in FIG. 13 is the same as that in FIG. 11.

<Basic Operation>

Now, the main routine shown in FIG. 5 waits for data input to the registers T0, C, and B upon interruption from the pitch extraction digital circuit 2 (FIG. 2) by repeating the loop of steps M2 and M10, as has been described in Section "Operation of Interruption Processing Routine".

When data is input and the contents of the registers are read in step M3 in FIG. 5, the flow advances to step M5 via step M4, i.e., the control transits to STEP 0 in FIG. 6. In this state, for example, as shown in FIG. 13, the present zero-cross time $t=t_0$, the positive/negative flag $b=0$, and the present peak value is the minimum peak value $c=b_0$ (absolute value) since $b=0$. Note that in FIG. 13, b and $b_0$ to $b_3$ and the like are different symbols.

It is checked in step SO1 in FIG. 6 if the present peak value c is larger than the absolute trigger level (positive threshold value for note-on operation) TRLAB(b). This checking operation is executed for positive and negative polarities on the basis of the value of the present positive/negative flag b. The positive absolute trigger level TRLAB(1) and the negative absolute trigger level TRLAB(0) can be set to be different values according to an experience in consideration of a case wherein an offset is superposed on the digital output D1 (FIG. 2). In an ideal system, these trigger levels can be the same value. In FIG. 13, the present minimum peak value $c=b_0$ (absolute value) is compared with TRLAB(b)=TRLAB(0), an yields $c=b_0>$TRLAB(0), that is, YES is obtained in step SO1.

After step SO2 (to be described later), processing in step SO3 is executed. The present positive/negative flag b is written in a flag MT, and data "1" written in the register STEP to prepare for transition to the next step. Furthermore, the present zero-cross time t is set as old zero-cross time data TFN(b) for the following processing. In FIG. 13, MT=b =0, and TFN(b)=TFN(0)=$t=t_0$.

In step SO4, flags (excluding constants) other than the flags described in the Section "Description of Variables" are initialized.

In step SO5, the present peak value c is set as an old peak value AMP(b) (absolute value) for the following processing, and the flow returns to step M2 in the main routine in FIG. 5. In FIG. 13, AMP(b) =AMP(0) $=c=b_0$.

With the above processing, in FIG. 13, the present positive/negative flag $b=0$ of the register B is written in the flag MT, the present zero-cross time data $t=t_0$ of the register T0 is written as the negative old zero-cross time data TFN(0), and the present minimum peak value $c=b_0$ of the register C is written as the negative old peak value AMP(0), as indicated between STEP 0 and STEP 1.

<Resonance Removal Operation>

Note that it is determined in step S01 in FIG. 6 that the present peak value c is equal to or smaller than the absolute trigger level TRLAB(b), the control does not transit to the note-on processing. In this case, only the present peak value c is set as the old peak value AMP(b) in step S05, and the flow returns to the main routine shown in FIG. 5. However, when one string is plucked and another string is resonated, the vibration level of the another string is gradually increased. YES is then obtained in step S01 in FIG. 6, and the flow advances to the processing in step S02. However, in this case, since no regular plucking operation is performed, it is not proper that the control transits to the note-on operation. Thus, in the processing in step S02, the resonance is removed. More specifically, in this case, since the present peak value c is not almost increased as compared to the old peak value AMP(b), when a difference c−AMP(b) is not larger than the resonance removal threshold value TRLRS, it is determined that the resonance state occurs. Thus, the control does not transit to the note-on processing, and the present peak value c is set in the old peak value AMP(b) in step S05, and the flow returns to the main routine in FIG. 5. On the other hand, when a regular plucking operation is performed, as shown in FIG. 13, a waveform rises immediately, and the difference c−AMP(b) of the peak values exceeds the resonance removal threshold value TRLRS, and the flow advances from step S02 to step S03, as described above.

<Relative On Entry Operation>

In FIG. 6, a node A corresponds to a relative-on (tone regeneration start) entry, and the flow jumps from the flow in STEP 4 (to be described later) to step S06. In step S06, the present output musical tone is muted, and the flow advances to step S03 to start tone regeneration. Processing for starting tone regeneration is the same as that when normal tone generation is started, as described above. Note-off processing in step S06 is the same as that in step M16 in FIG. 5.

(Processing Operation in STEP 1)

Figure 7:
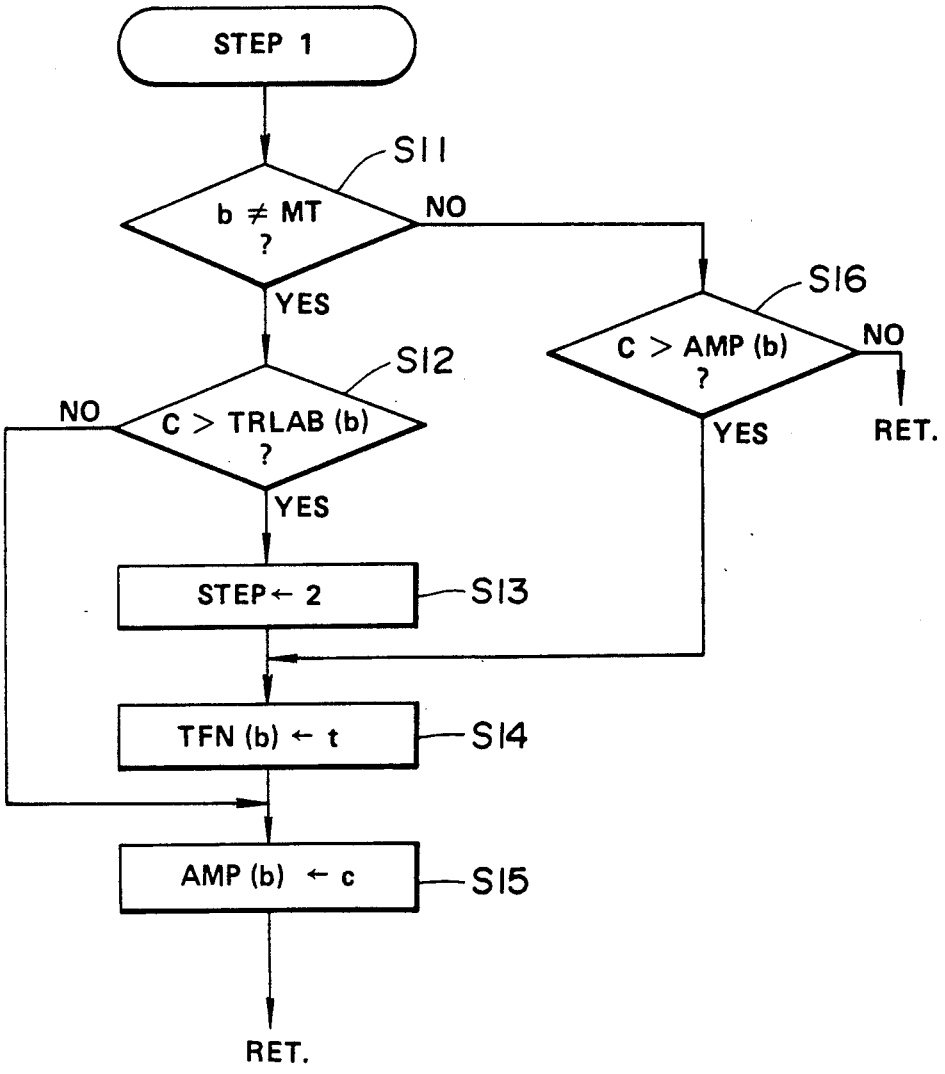
FIG. 7 is an operation flow chart of processing STEP 1 shown in FIG. 5.

FIG. 7 is an operation flow chart of processing in STEP 1 as step M6 in the main routine shown in FIG. 5. In this processing, initialization for pitch extraction processing after STEP 0, transition processing to following STEP 0 or repetition processing (error processing) when an abnormal waveform is input, and the like are performed.

<Basic Operation>

After initialization for the first data is performed in STEP 0, the main routine shown in FIG. 5 waits for data input to the registers T0, C, and B upon interruption for the second time from the pitch extraction digital circuit 2 (FIG. 2) by repeating the loop of step M2→M10→M11→M2.

When data is input and the contents of the registers are read in step M3 in FIG. 5, the flow advances to step M6, i.e., STEP 1 in FIG. 7 via step M4. In this state, for example, as shown in FIG. 13, the present zero cross time $t=t_1$, the present positive/negative flag $b=1$, and the present peak value is the maximum peak value, $c=a_0$ since $b=1$.

After step S11 in FIG. 7 (to be described later), it is checked in step S12 if the present peak value c is larger than the absolute trigger level TRLAB(b), in the same manner as has been described in a description of step S01 in FIG. 6 in Section -Processing Operation in STEP 0. In FIG. 13, the present maximum peak value, $c=a_0$ is compared with TRLAB(b) =TRLAB(l) and the result is $c=a_0>$TRLAB(1), that is YES is obtained in step S12.

In step S13, data "2" is written in the register STEP to prepare for transition to the next step. In step S1, the present zero-cross time t of the register T0 is set as old zero-cross time data TFN(b) for the following processing. In step S15, the present peak value c of the register C is set as the old peak value AMP(b) for the following processing, and the flow returns to the processing in step M2 of the main routine shown in FIG. 5. In FIG. 13, TFN(1)$=t=t_1$, and AMP(1)$=c=a_0$. Note that the content of the flag MT is not rewritten and is kept to be "0".

<Operation of Repetition Processing>

When the normal digital output D1 as shown in FIG. 13 is input, after the negative (minimum)/positive (maximum) peak value(absolute value) is extracted in STEP 0, other side peak value i.e., positive (maximum/negative (minimum) peak value is extracted in STEP 1. Therefore, in step S11 in FIG. 7, since the present positive/negative flag b=1(0) is different from the flag MT=0(1) set in STEP 0, the flow advances to step S12, as described above.

Figure 14A:
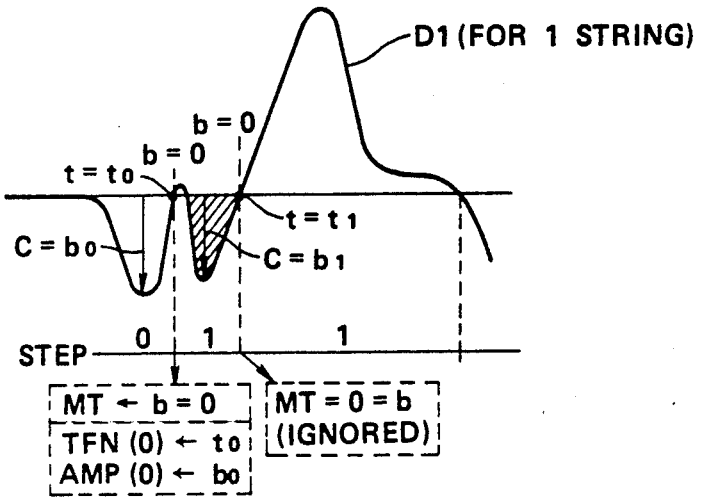
FIGS. 14A and 14B are charts for explaining repetition processing in STEP 1.
Figure 14B:
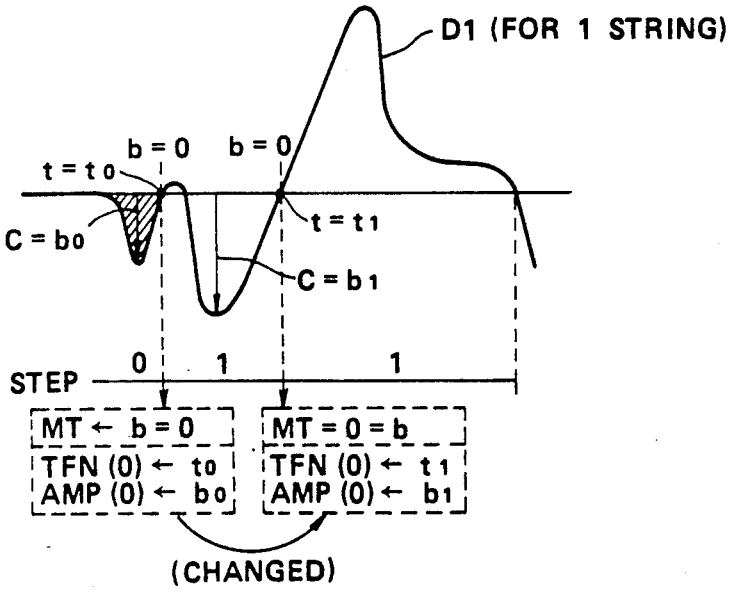

However, in some cases, a waveform shown in FIG. 14A or 14B may be input in STEP 1 after STEP 0. In this case, after the negative minimum peak value $b_0$ is extracted in STEP 0, the negative minimum peak value $b_1$ is repetitively extracted in STEP 1. Therefore, in step S11 in FIG. 7, the present positive/negative flag b=0, and coincides with the flag MT=0 setin STEP 0. In this case, the flow advances to step S16 in FIG. 7, and repetition processing (error processing) is executed.

It is checked in step S16 if the peak value c is larger than the old peak value AMP(b) having the same sign.

In the case of FIG. 14A, $c=b_1>$AMP(b)=AMP(0) $=b_0$ cannot be established. In this case, the present minimum peak value $b_1$ is ignored as an abnormal waveform (hatched portion), and the content of the register STEP is not updated. The flow returns to the processing in step M2 in the main routine shown in FIG. 5, and inputting of the next normal peak is waited for.

In the case of FIG. 14B, $c=b_1>$AMP(b)=AMP(0) =b0 can be established. In this case, the minimum peak value $b_0$ extracted in the preceding STEP 0 is ignored as an abnormal waveform (hatched portion), and the contents of the negative old zero-cross time data TFN(0) and negative old peak value AMP(0) set in STEP 0 are updated to the present zero-cross time t and the present peak value c in steps S14 and S15 in FIG. 7. More specifically, in FIG. 14B, TFN(0)$=t=t_1$ and AMP(0) $=c=b_1$. After the repetition processing, the content of the register STEP is not updated (without going through step S13 in FIG. 7), and the flow returns to the processing in step M2 of the main routine in FIG. 5. Thus, inputting of the next normal peak is waited for.

After the above-mentioned operation, when the normal peak value is input, the above-mentioned processing is performed in step S11→S12→S13→S14 S15 in FIG. 7, and for example, when $t=t_1$, the control transits to the next processing of STEP 2, as shown in FIG. 13.

(Processing Operation in STEP 2)

Figure 8:
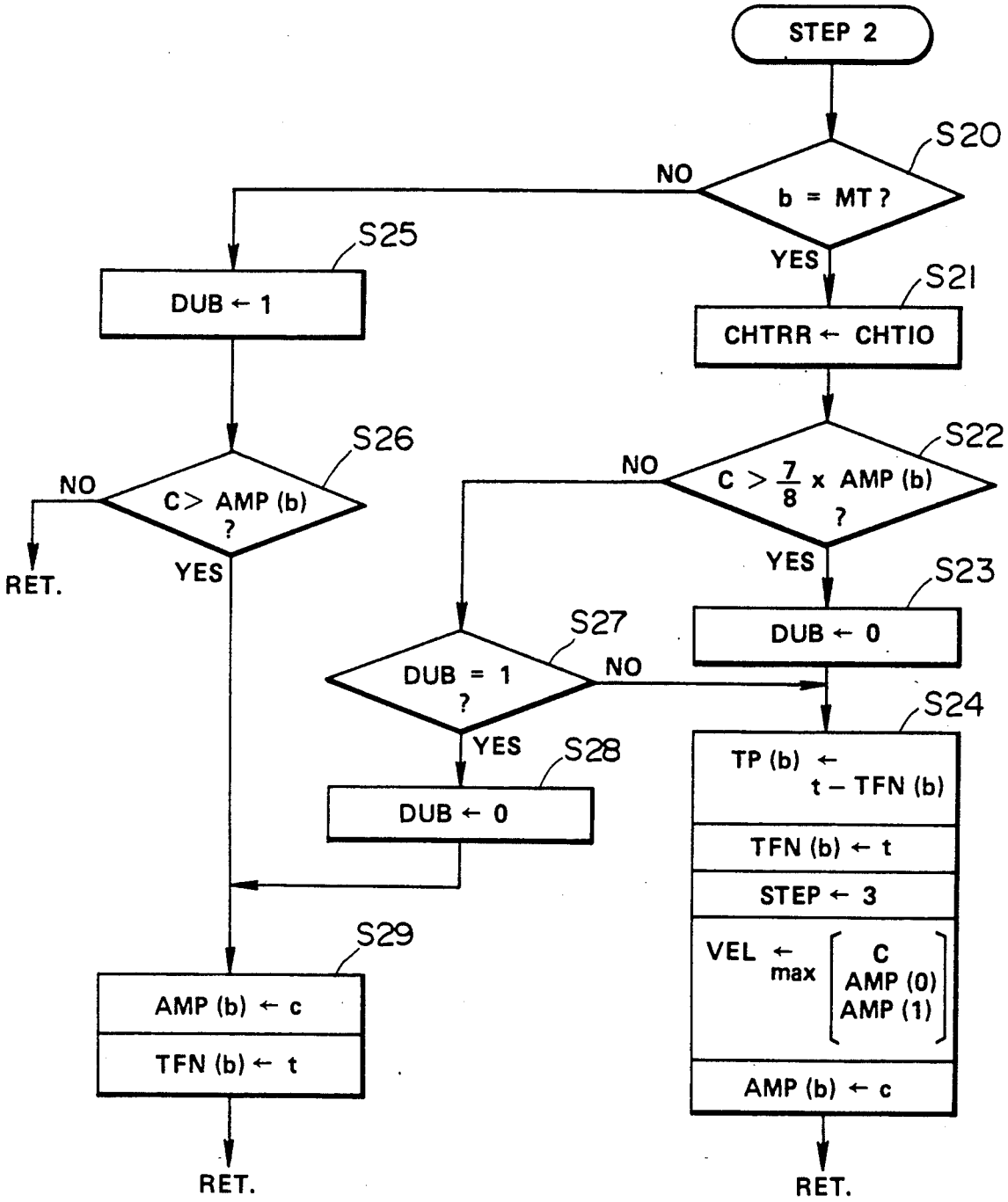
FIG. 8 is an operation flow chart of processing STEP 2 shown in FIG. 5.

FIG. 8 is an operation flow chart of the processing in STEP 2 as step M7 in the main routine of FIG. 5. In this processing, detection of a first pitch period for pitch extraction, setting of a velocity, transition processing to STEP 3 or error processing (repetition processing) when an abnormal waveform is input, and the like are executed.

<Basic Operation>

After the processing in STEP 1 is performed, the main routine shown in FIG. 5 waits for data input to the registers T0, C, and B upon interruption again from the pitch extraction digital circuit 2 (FIG. 2) by repeating the loop of step M2→M10→M11→M2.

When data is input and the contents of the registers are read in step M3 in FIG. 5, the flow advances to step M7, i.e., STEP 2 in FIG. 8 via step M4. In this state, for example, as shown in FIG. 13, the present zero-cross time $t=t_2$, the present positive/negative flag b=0, and the present peak value is the minimum peak value, $c=b_1$ since b=0.

After step S20 in FIG. 8 (to be described later), in step S21, the MCP 3 sets the open string fret period CHTIO of a string, which is presently subjected to processing, in the time constant conversion no register CHTRR in the time constant conversion controller 202 in FIG. 3 through the bus BUS. As has been described with reference to the time constant conversion controller 202 in Section "Operation of Pitch Extraction Digital Circuit", after the peak detector 201 (FIG. 3) detects a vibration at the leading edge of the waveform of the digital output D1, the peak hold signal (p1, q2, and the like in FIG. 11) output from the peak hold circuit in the peak detector 201 is immediately attenuated in the lapse of an open string period of each string, i.e., a lowest tone period CHTIO so that the detector 201 does not pick up an overtone of each pitch period.

It is checked in step S22 if the present peak value c is larger than a $\frac{7}{8}$ multiple of the old peak value AMP(b) having the same sign. As will be described later, since a waveform obtained by plucking a string is naturally attenuated, YES is obtained in step S22, and the flow advances to step S24 via step S23 (to be described later).

In step S24, {(present zero-cross time t) −(old zero-cross time data TFN(b) having the same sign} is calculated to detect the first pitch period. The difference is set as old period data TP(b) so as to be used as a note-on (tone generation start) condition in STEP 3 (to be described later). In FIG. 13, $TP(0)=t-TFN(0)=t_2-t_0$.

In step S24, the present zero-cross time t is set as the old zero cross time data TFN(b) for the following processing. In FIG. 13, $TFN(0)=t=t_2$. Note that $TFN(0)=t_0$ set in STEP 0 is no longer necessary and is erased since the old period data $TP(b)=TP=t_0$ can be calculated.

In step S24, data "3" is written in the register STEP to prepare for transition to the next step.

Furthermore, in step S24, for the following processing, a largest one of the present peak value c, and the old peak values AMP(0) and AMP(l) is set as the velocity VEL. Note that the velocity VEL is used as a value for determining a tone volume of a musical tone, as will be described later in STEP 3. Similarly, the present peak value c is set as the old peak value AMP(b), and the flow returns to the processing in step M2 of the main routine shown in FIG. 5. In FIG. 13, $VEL=\max\{c, AMP(0), AMP(1)\}=\max\{b_1, b_0, a_0\}$, and hence, $AMP(0)=c=b_1$. Note that $AMP(0)=b_0$ set in STEP 0 is no longer necessary and is erased since the velocity VEL ca be calculated.

<Operation of Repetition Processing>

When the normal digital output D1 as shown in FIG. 13 is input, after the positive (maximum)/negative (minimum) peak value is extracted in STEP 1, the other peak value i.e., negative (minimum) positive (maximum) peak value is extracted in STEP 2. Therefore, in this case, the sign of the peak value in STEP 2 is opposite to that in STEP 1, and is the same as that in STEP 0. In step S20 in FIG. 8, the present positive/negative flag b=0 (1) coincides with the flag MT=1(0) set in STEP 0, and the flow advances to step S21, as described above.

Figure 15A:
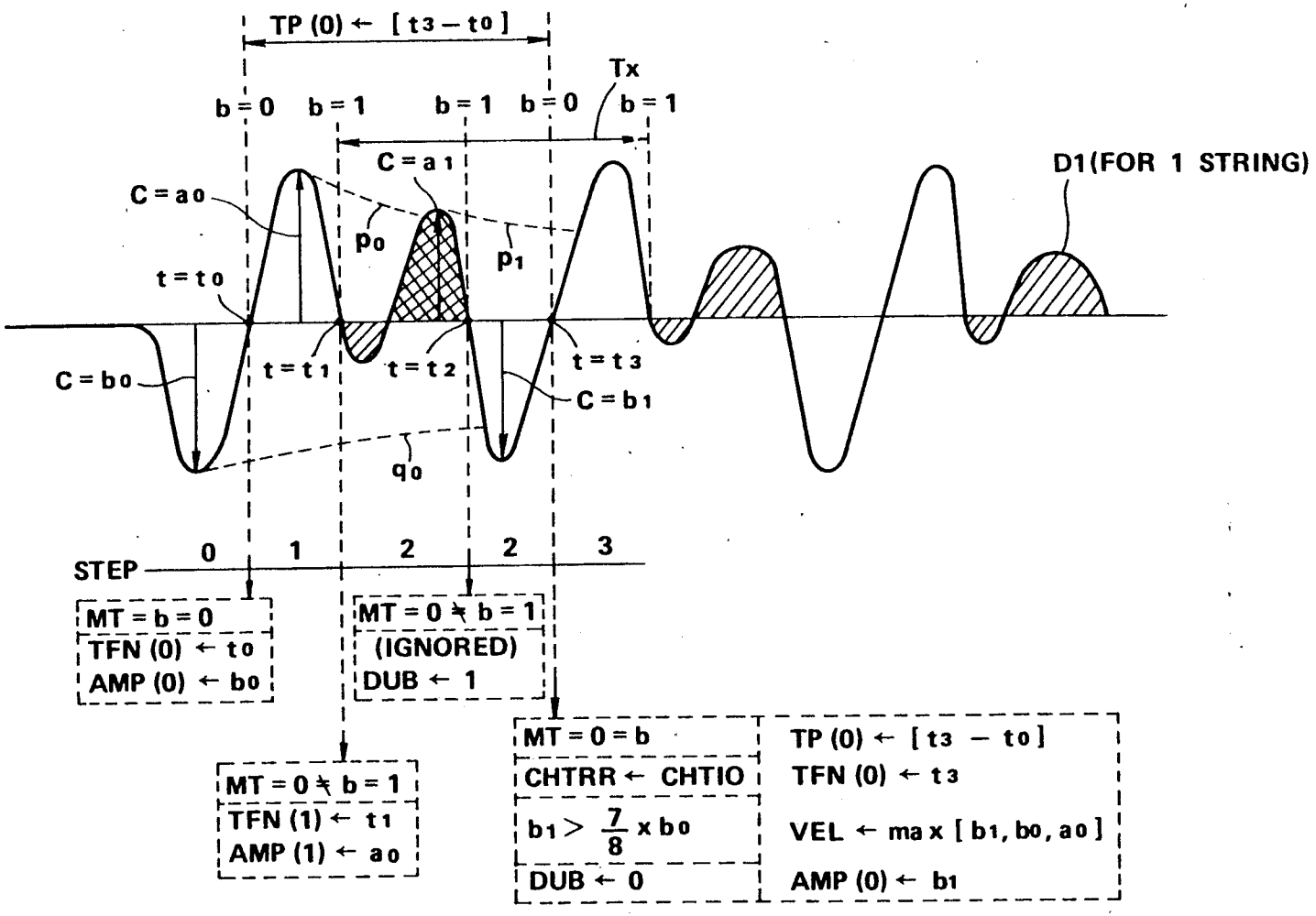
FIGS. 15A, 15B, and 15C are charts for explaining repetition processing in STEP 2.

However, as has been described in the description of Sub-section "Operation of Repetition Processing" in Section "Processing Operation in STEP 1", waveforms may be repetitively input after STEP 1, as shown in FIG. 15A or 25B. In this case, after the positive (maximum) peak value $a_0$ is extracted in STEP 1, the positive (maximum) peak value $a_1$ is repetitively extracted in STEP 2. Therefore, in step S20 in FIG. 8, the present positive/negative flag b=1, and coincides with the flag MT=0 set in STEP 0. In this case, the flow advances to step S25 in FIG. 8, and repetition processing (error processing) is executed. Note that peaks indicated by simple hatching are not detected as peak values, as they do not exceed the peak hold signals $p_0$, $p_1$, $g_0$ shown in FIG. 15A or 15B generated from the peak hold circuit in the peak detector 201 shown in FIG. 3.

In step S25, the repetition flag DUB is set to be "1" (to be described later), and the flow then advances to step S26 to check if the present peak value c is larger than the old peak value AMP(b) having the same sign.

Assuming that STEP 2 is executed at $t=t_2$ after STEP 0 ($t=t_0$) and STEP 1 ($t=t_1$), $c=a_1>AMP(b)=AMP(1)=a_0$ cannot be established. More specifically, NO is obtained in step S26 in FIG. 8. In this case, the present peak value $a_1$ is ignored as an abnormal waveform (cross-hatched portion in FIG. 15A). Thus, the register STEP is not updated, and the flow returns to the processing in step M2 in the main routine shown in FIG. 5 to wait for the next normal peak. When the minimum peak value $c=b_1$ is input at $t=t_3$, YES is obtained in step S20 in FIG. 8, and the processing in step S21→S22→S23→S24 is executed in the same manner as in FIG. 13. At $t=t_3$ in FIG. 14A, the control transits to the next processing in STEP 3. Note that the old period data TP(0) set in step S24 in FIG. 8 corresponds to a difference between the present zero-cross time $t_3$ and the old zero cross time $t_0$ set in STEP 0, as shown in FIG. 15A. The start point of the next period data $T_x$ calculated in STEP 3 (to be described later) corresponds the old zero-cross time $TFN(1)=t_1$ set in STEP 1 since the cross-hatched peak ($c=a_1$) is ignored, as shown in FIG. 15A.

Figure 15B:
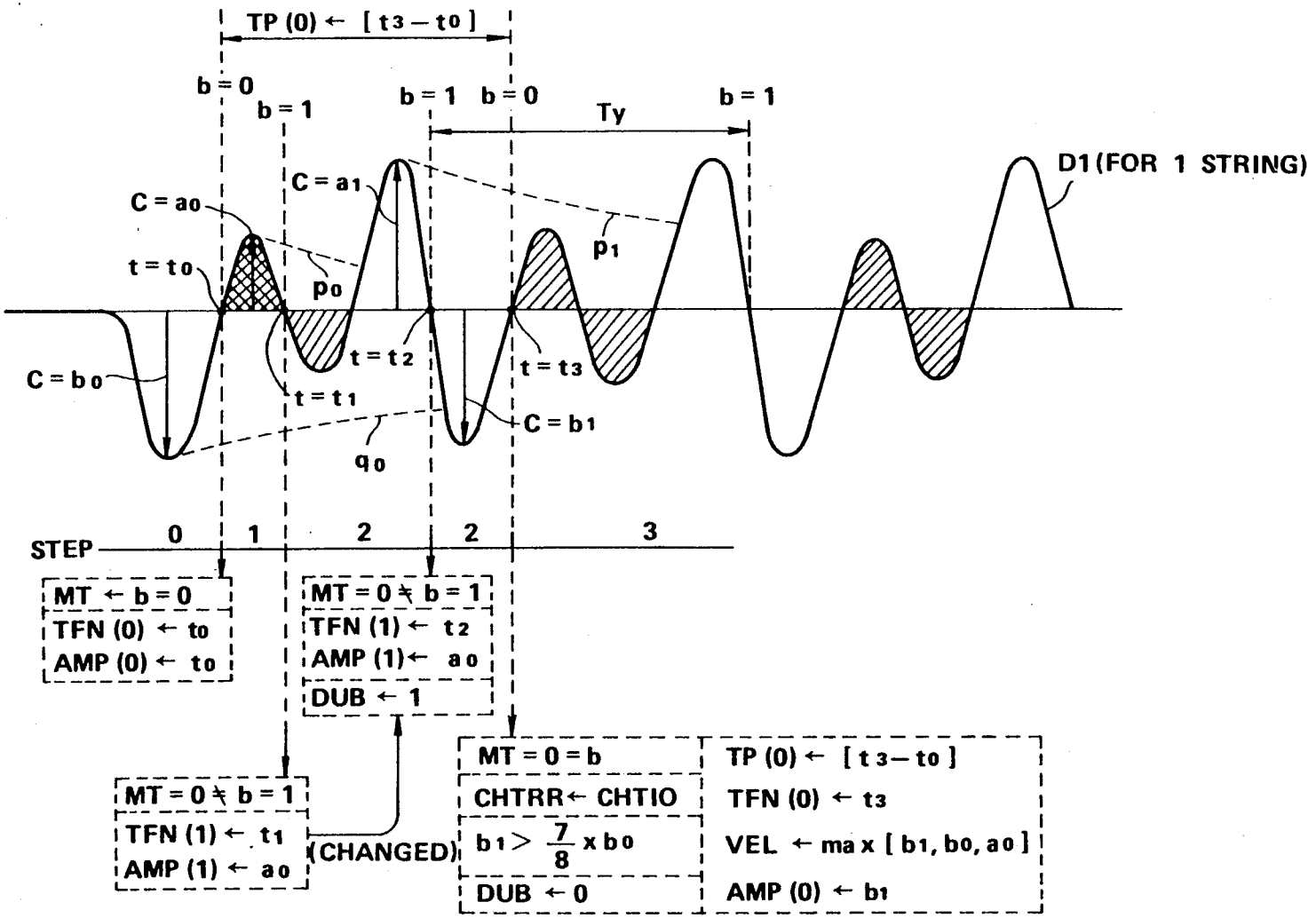

On the contrary, in FIG. 15B, $c=a_1>AMP(b)=AMP(1)=a_0$ can be established. That is, YES is obtained in step S26 in FIG. 8. In this case, the maximum peak value $a_0$ extracted in the preceding STEP 1 is ignored as an abnormal waveform (cross-hatched portion in FIG. 14B), and the contents of the old zero-cross time data TFN(1) and the positive old peak value AMP(1) are updated to the present zero-cross time t and the present peak value c in step S29 in FIG. 8. More specifically, in FIG. 15B, $TFN(1)=t=t_2$ and $AMP(1)=c=a_0$. After the repetition processing, the register STEP is not updated, and the flow returns to the processing in step M2 in the main routine shown in FIG. 5 to wait for inputting of the next normal peak value. Thereafter, the processing after the minimum peak value $c=b_1$ is input at $t=t_3$ is the same as that in FIG. 15A. However, since the peak (cross-hatched peak $c=a_0$ in FIG. 15B) extracted in STEP 1 is ignored and is updated to the peak $c=a_1$, the start point of the next period data $T_x$ of TP(0) calculated in STEP 3 (to be described later) corresponds to the old zero-cross time $TFN(1)=t_2$ set in the repetition processing in STEP 2, and is different from that in FIG. 15A.

As shown in FIG. 15A or 15B, when waveforms are repetitively input, a peak having a smaller peak value is ignored as an abnormal waveform, and error processing is executed.

A branch at step S22 in FIG. 8 for other cases of the repetition processing will be explained below.

When the processing in STEP 2 in FIG. 8 is executed, since a normal waveform obtained by picking a string is smoothly and naturally attenuated, the present peak value becomes larger than a $\frac{7}{8}$ multiple of the old peak value AMP(b) having the same sign in step S22, and YES is obtained in step S22. Thus, the flow advances to step S23.

In some cases, however, $c>(\frac{1}{2})\times AMP(b)$ cannot be established. In a first case, for example, when a string is plucked near the bridge, adjacent peaks of a waveform occurred right after the leading edge of the waveform can be extremely different in level. In this case, although the waveform is normal, it is not smoothly attenuated, and NO may often be obtained in step S22. In this case, the processing in step S24 in FIG. 8 must be normally performed. Since the waveform is normal, the above-mentioned repetition does not occur, and the flow does not branch from step S20 to step S25 in FIG. 8. Therefore, the repetition flag DUB is kept to be "0". If DUB =1 is not established in step S27 in FIG. 8, the flow returns to step S24 regardless of the judgment result in step S22, and the processing described in Sub-section "Basic Operation" is executed. Note that the repetition flag DUB is initialized to 0 in the processing of step S04 in STEP 0 in FIG. 6.

In a second case, step S22 in FIG. 7 cannot be established when repetition of waveforms described above occurs. This case will be explained below with reference to FIG. 15C.

Figure 15C:
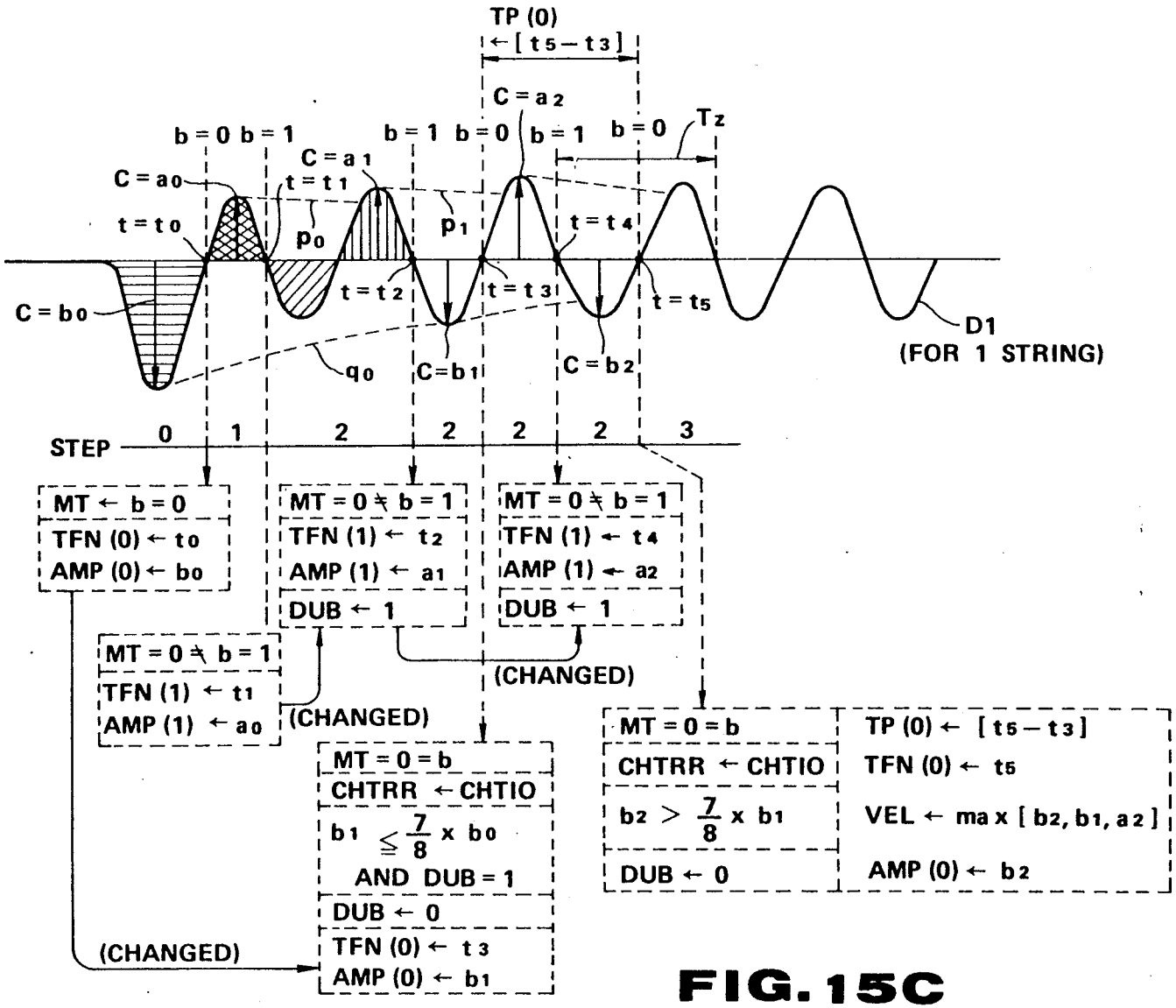

As shown in FIG. 15C, the repetition processing is performed at $t=t_2$ after the processing of STEP 0 ($t=t_0$) and STEP 1 ($t=t_1$), and the peak $c=a_0$ (cross-hatched peak in FIG. 14C) is removed while the peak $c=a_1$ (vertically hatched peak in FIG. 15C) is left, in the same manner as has been described in FIG. 15B. Note that the simple-hatched peak ($c=a_1$) is not originally detected as in FIG. 15A or 15B.

When the repetition occurs as described above, since the positive/negative flag becomes $b=0$ at the next $t=t_3$, as shown in FIG. 15C, it coincides with the flag MT =0 set in STEP 0. Therefore, the flow advances from step S20 to the processing in step S22 via step S21 in FIG. 8. However, the present minimum peak value $c=b_1$ detected at $t=t_3$ is much smaller than the old minimum peak value AMP(0) having the same sign due to repetition of the waveforms, and is largely attenuated. Therefore, as shown in FIG. 15C, NO may be obtained in step S22 in FIG. 8.

In this case, since the repetition processing is performed at $t=t_2$, the value of the repetition flag DUB is "1". Therefore, NO is obtained in step S27 in FIG. 8, and the flow advances to step S29 via step S28 (to be described later).

In step S29, in order to restart processing by acquiring a normal waveform after $t=t_3$ in FIG. 15C, the contents of the old zero-cross time data TFN(0) and the negative old peak value AMP(0) set in STEP 0 are updated to the present zero-cross time t and the present peak value c in step S29 in FIG. 8. More specifically, in FIG. 15C, $TFN(0)=t=t_3$ and $AMP(0)=c=b_1$. As a result, the horizontally hatched peak ($c=b_0$) in FIG. 15C is ignored. For the following processing, the repetition flag DUB is reset to "0" in step S28 in FIG. 8. After the above-mentioned operations, the content of the register STEP is not updated, and the flow returns to the processing in step M2 of the main routine in FIG. 5 to wait for the next peak input.

In the above case, as shown in FIG. 15C, STEP 2 in FIG. 8 is repeated at $t=t_4$ and $t=t_5$, and the control then transits to STEP 3. The repetitive operation of STEP 2 described above includes various patterns, and a detailed description thereof will be omitted. A normal waveform can be acquired as the entire control flow, and an operation is performed to effectively determine the data TFN(0), AMP(0), TFN(1), and AMP(1) used for next STEP 3. Thereafter, the control transits to STEP 3. Note that in the case shown in FIG. 15C, $tp(0)=t_5-t_3$, and the start point of the next period data $T_2$ calculated in STEP 3 (to be described later) corresponds to $TFN(1)=t_4$.

(Processing Operation in STEP 3)

Figure 9:
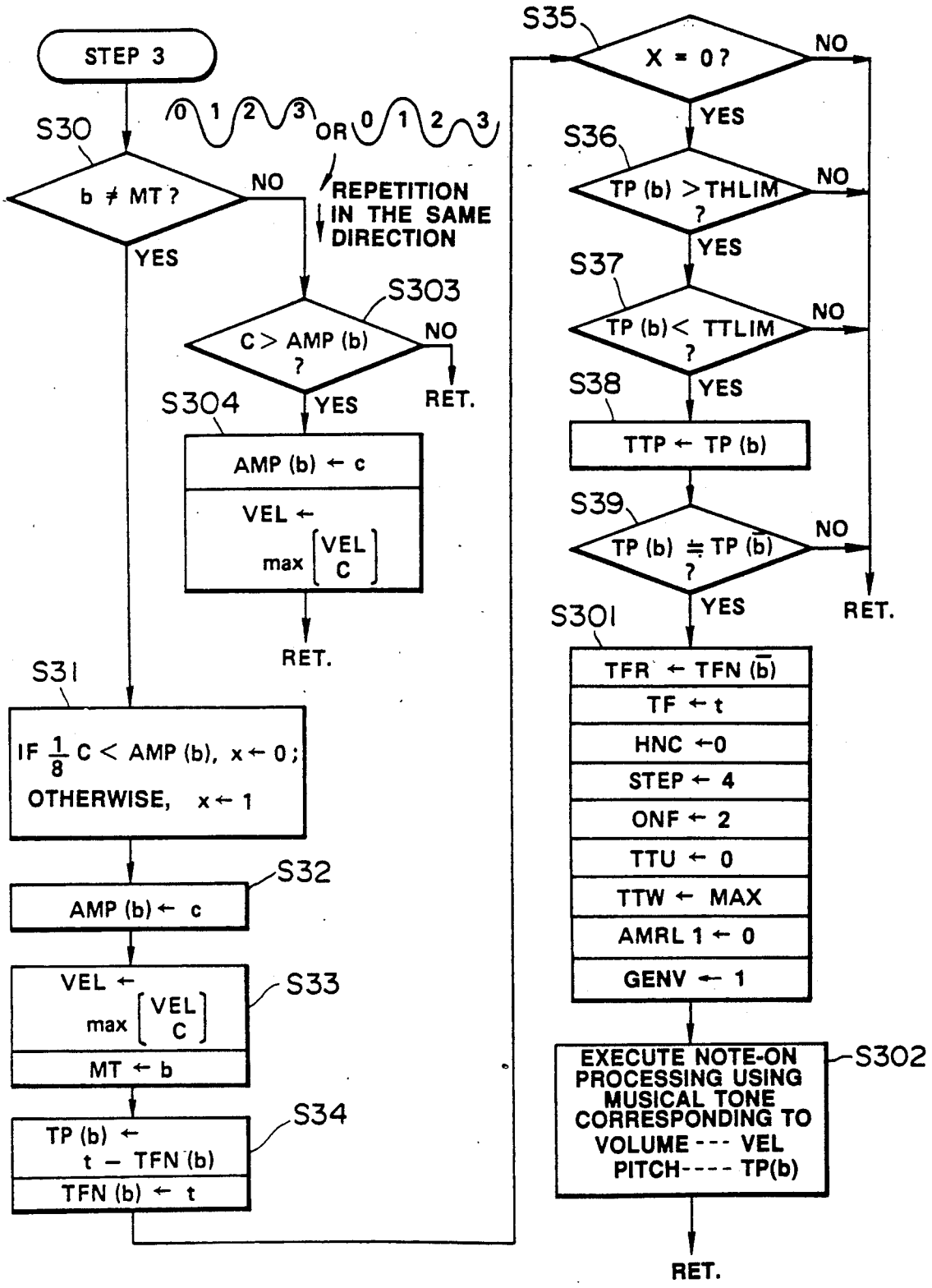
FIG. 9 is an operation flow chart of processing STEP 3 shown in FIG. 5.

FIG. 9 is an operation flow chart of processing in STEP 3 as step M8 in the main routine of FIG. 5. In this processing, note-on (tone generation start) processing, extraction of a pitch period for setting a pitch for note-on operation, calculations of velocity, transition processing to STEP 4, error processing when an abnormal waveform is input, and the like are executed.

<Basic Operation>

After the processing in STEP 3 is executed, the main routine shown in FIG. 5 waits for next data input to the registers T0, C, and B upon interruption again from the pitch extraction digital circuit 2 (FIG. 2) by repeating the loop of step M2→M10→M11→M2.

When data are input and the contents of the registers are read in steps M2 to M3 in FIG. 5, the flow advances to step M8, i.e., STEP 3 in FIG. 9 via step M4. In this state, as shown in FIG. 13, the present zero-cross time $t=t_3$, the present positive/negative flag $b=1$, and the present peak value is the maximum peak value, $c=a_1$ since $b=1$.

Note that after steps S30, S31, and S32 in FIG. 9 (to be described later), a tone volume parameter VEL is calculated in step S33. A largest one of the three previous peak values ($b_0$, $a_0$, and $b_1$ (absolute values) in FIG. 13) is stored in the velocity VEL in step S24 in FIG. 8, as has been described in Sub-section "Basic Operation" in Section "Processing Operation in STEP 2". In step S33 in FIG. 9, a larger value out of the velocity VEL and the present peak value c is selected, and is determined as the tone volume parameter VLM used when the musical tone generator 5 (predetermined one of #1 to #n) (FIG. 2) generates a musical tone. In FIG. 13, since $VEL=a_0$ and $c=a_1$, $VEL=\max[a_0, a_1]=a_0$.

After the above operation, the processing, MT←b, is executed in step S33 and the flow advances to step S34 in FIG. 9 (to be described later). In step S34, {(present zero-cross time t)−(old zero-cross time data TFN(b) having the same sign)} is calculated to detect a pitch period, and the detected period is set as old period data TP(b). In FIG. 13, $TP(1)=t_3-t_1$.

After steps S35 to S38 in FIG. 9 (to be described later), it is checked in step S39 if the old period data TP(b) calculated in step S34 is substantially equal to the old period data TP($\bar{b}$) set in step S24 in FIG. 8 and having the different polarity from that of the above TP(b). If YES in step S39, since it can be determined that the pitch period can be started to be stably extracted, note-on processing is executed in step S302 viastep S301 (to be described later). In FIG. 13, it is determined that the negative old period data $TP(1)=t_3-t_1$ is substantially equal to the positive old period data $TP(0)=t_2-t_0$, and the control transits to the note-on processing. Note that a case wherein NO is obtained in step S39 will be described later.

In step S302, corresponding tone volume data, and tone pitch data are generated on the basis of the tone volume parameter VEL calculated in step S33 in FIG. 9 and the old pitch period TP(b) extracted in step S34, and are output to the musical tone generator 5 (to the corresponding one out of #1 to #n) through the MIDI-BS and the interface MIDI shown in FIG. 2. The generator 5 generates a musical tone having a tone volume, and tone pitch corresponding to the input data in real time. In this manner, in this embodiment, since note-on operation is performed in about 1.5 periods after the waveform rises, as indicated at $t=t_3$ in FIG. 13, a musical tone can be generated to satisfactorily follow the vibration waveform of a string.

Simultaneously with the note-on processing, parameters used in STEP 4 next are set in steps S38 and S301 in FIG. 9, and the flow returns via step S306 to the processing in step M2 of the main routine shown in FIG. 5. Thus, the control transits to the next STEP 4. More specifically, in step S38, the old period data TP(b)

extracted in step S34 is set as the previously extracted period data TTP. In step S301, the old zero-cross time data TFN($\bar{b}$) set in step S24 in STEP 2 of FIG. 8 is set in the time storing register TFR, the present zero-cross time data t is set as valid old zero-cross time data TF, a waveform number counter HNC is cleared to "0", the value of the register STEP is updated to "4", the note-on flag ONF is set to be "2" (sound generation state), the constant TTU is set to be "0" (minimum MIN), the constant TTW is set to be maximum MAX, and the old amplitude value AMRL1 for relative off check is cleared to "0". The envelope data GENV is set at the maximum value "1". These parameters will be described later in STEP 4.

<Operation When Period is Inappropriate>

When the old period data TP(b) is detected in step S34 in FIG. 9, the pitch period must be longer than a period generated when the corresponding string is plucked at its highest fret, and shorter than the open string period of the string.

As the constant, i.e., the upper limit frequency THLIM, a period of a pitch higher by 2 to 3 halftones than a pitch determined by the highest tone fret of a string which is presently subjected to processing, and as the constant, i.e., the lower limit frequency TTLIM, a period of a pitch lower by 5 halftones or less than a pitch determined by the open string state of the identical string is set. In steps S36 and S37 in FIG. 9, it is checked if the old period data TP(b) calculated in step S34 is larger than THLIM and is smaller than TTLIM. If YES is obtained in both steps S36 and S37, the flow advances to step S39, and the period judgment processing described above is performed.

If NO in step S36 or S37, it is determined that the old period data TP(b) extracted in step S34 is inappropriate. Therefore, in this case, the flow returns from step S36 and S37 to the processing in step M2 in the main routine of FIG. 5, and STEP 3 is repeated.

If it is determined in step S39 in FIG. 9 that the old period data TP(b) calculated in step S34 is different from the old period data TP($\bar{b}$) having the different polarity, an overtone or the like may be accidentally extracted and an accurate pitch period fails to obtain. In this case, the pitch period cannot be stably extracted. Therefore, NO is obtained in step S39, and the flow returns to the processing in step M2 in the main routine of FIG. 5 to repeat STEP 3.

When STEP 3 is repeated with the above operations, in a normal waveform, the polarities of a newly detected peak via step M2 and M3 in FIG. 5 are alternately switched, and the value b is alternately inverted to be 0 and 1. In addition, in step S33 in FIG. 9, the value of the flag MT is alternately updated, and in step S34, new TP(b) is calculated and the content of TFN(b) is updated. Therefore, judgment in steps S36 and S37 is performed for the latest pitch period, and judgment in step S39 is performed for the latest pitch period and second latest pitch period (before about half a period) having the opposite polarity. When the pitch periods can be stably extracted, the control transits to the note-on processing.

In step S33 in FIG. 9, the velocity VEL is updated accordingly in correspondence with the newly detected peak.

<Operation of Noise Removal Processing>

Figure 16:
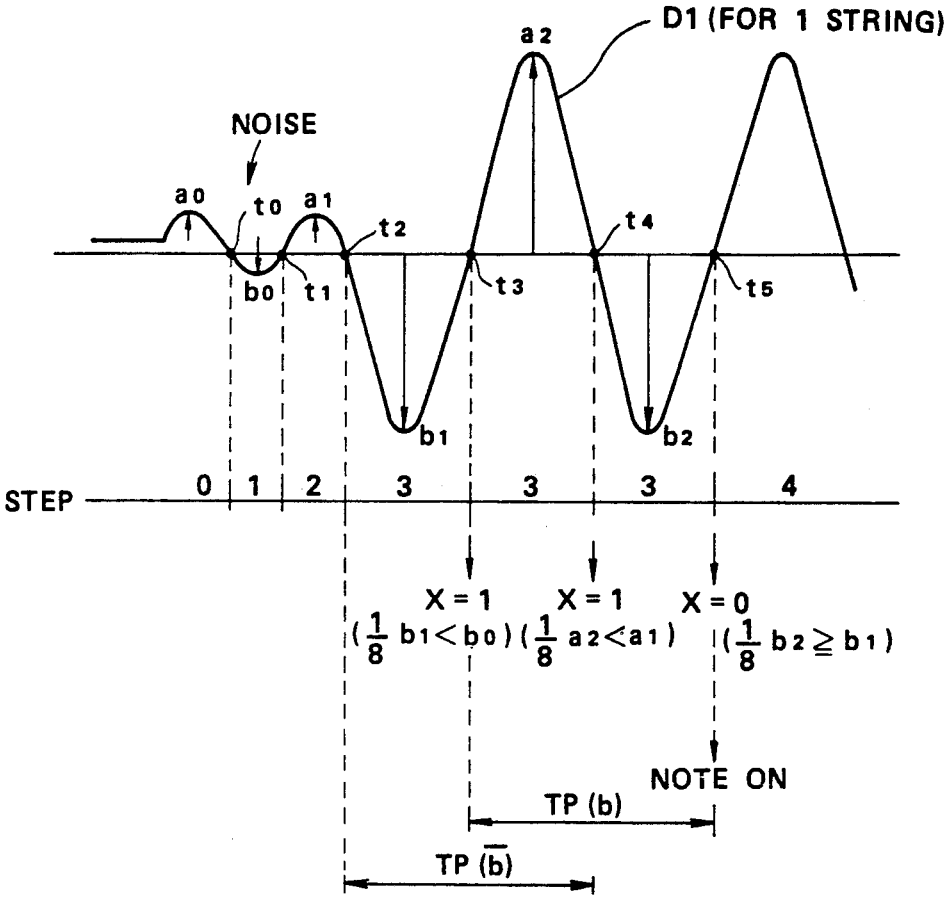
FIG. 16 is a chart for explaining noise removal processing operation in STEP 3.

The processing in step S31 in FIG. 9 is performed to cope with a case wherein a noise component appears in the leading edge portion of the waveform. Assume that peaks $a_0$, $b_1$, $a_1$, and the like caused by noise are accidentally detected in STEPs 0, 1, and 2, as shown in FIG. 16. If the periods of these noise components are detected and tone generation start is instructed, a quite unnatural musical tone is generated.

In step S31 in FIG. 9, when successive peak values are largely changed, it is determined that a noise component is generated, and the abnormal detection flag X is set to be "1". Thus, NO is obtained in step S35 so as to prevent note-on processing on the basis of the noise portion.

More specifically, normality is determined if a $\frac{1}{8}$ value of the present peak value c is smaller than the old peak value AMP(b) having the same sign, and the flag X is set to be "0"; otherwise, X=1 is set. If it is determined in step S35 that X is not set to be "0", the flow returns to the processing in step M2 in the main routine of FIG. 5 to repeat STEP 3. In this case, since the old peak value AMP(b) is sequentially updated in step S32 in FIG. 9, the processing in step S31 is performed for the latest peak value and the immediately preceding peak value having the same sign. When the successive peak values are free from a large change, the control transits to the note-on processing. In FIG. 16, both at $t=t_3$ and $t=t_4$, X=1 is determined in step S31. Therefore, the note-on processing is not performed. At $t=t_5$, since it is determined that at a normal peak is input for the first time, X=0 is determined in step S31, and the note-on processing is performed at $t=t_5$. In this case, the successive pitch periods TP(b) and TP($\bar{b}$) have normal values.

<Operation of Repetition Processing>

The judgment processing in step S30 in FIG. 9 is performed for repetition processing. If the normal waveform D1 as shown in FIG. 13 is input, the present positive;negative flag b=1 at $t=t_3$ does not coincide with the flag MT=0, and the flow advances to step S31, as described above.

However, as has been described in Sub-section "Operation of Repetition Processing" in Section "Processing Operation in STEP 1" or "Processing Operation in STEP 2", when the waveforms are repetitively input, NO is obtained in step S30 in FIG. 9.

When the repeating peak value c is smaller than the old peak value AMP(b) having the same sign, NO is obtained in step S303 in FIG. 9, and the repeating peak is ignored. Thereafter, the flow returns to the processing in step M2 in FIG. 4 to repeat STEP 3, based on the same consideration as in FIG. 15A and the like.

In contrast to this, if the repeating peak value c is larger, YES is obtained in step S303, and the flow advances to the processing in step S304. In step S304, the old peak value is ignored. The content of the AMP(b) is updated to the present peak value c, and the velocity VEL is calculated again using the updated value. Thereafter, the flow returns to step M2 in FIG. 5 to repeat STEP 3, based on the same consideration as in FIG. 14B and the like.

When the normal peak is input after the above-mentioned processing, YES is obtained in step S30, and YES is obtained in steps S35, S36, S37, and S39. Thus, the note-on processing is performed, and generation of a musical tone is started.

(Processing Operation in STEP 4)

Figure 10:
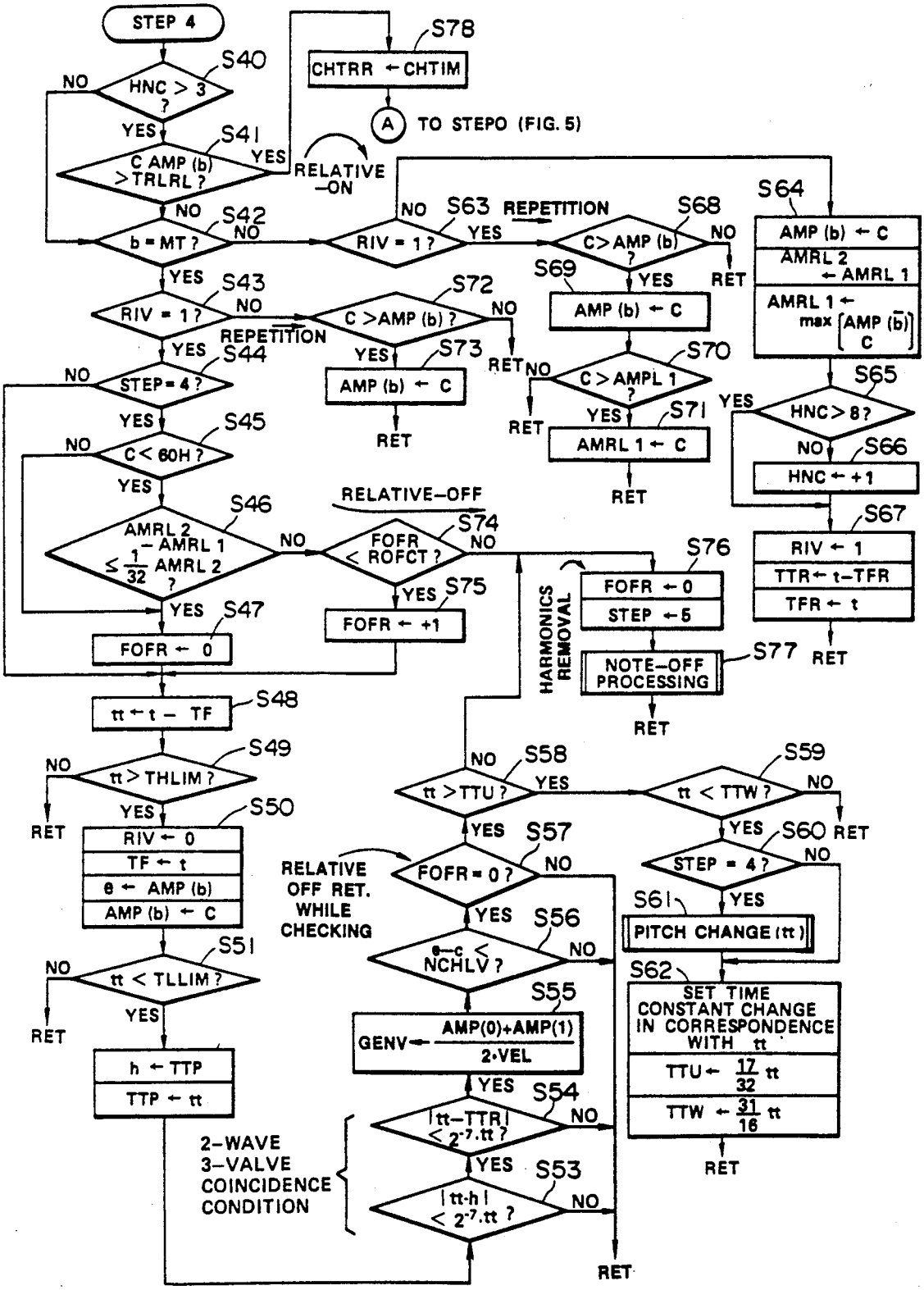
FIG. 10 is an operation flow chart of processing STEP 4 shown in FIG. 5.

FIG. 10 is an operation flow chart of processing in STEP 4 as step M9 in FIG. 5. In this processing, pitch extraction/change processing, extraction processing of envelope data directly relating to the present invention, relative-on/relative-off processing, processing when a pitch period is inappropriate, repetition processing, and the like are performed. The pitch extraction/change processing and the extraction processing of envelope data include a route for performing only pitch extraction and a route for actually changing a pitch and for extracting envelope data, and generally these routes are alternately repeated ever time a new peak is input.

<Operation of Pitch Extraction Processing (Route )>

The route shown in steps S40, S41, S42, and S63 to S67 will be described first. In step S40, whether or not the waveform number counter HNC>3 is checked. If YES in step S40, the flow advances to step S41. It is checked in step S41 if the relative-on threshold value TRLRL <(present peak value c−old peak value AMP(b) having the same sign.). If NO in step S41, the flow advances to step S42 (a case of YES will be described later). It is then checked in step S42 if the present positive/negative flag b=flag MT, i.e., a pitch is to be changed. If YES in step S42, the flow advances to step S43.

However, in an initial state, the content of the waveform number counter HNC is 0 (see step S301 in FIG. 9). Thus, NO is obtained in step S40, and the flow advances to step S42. For example, when the waveform as shown in FIG. 13 is input, since b=0 and MT=1 (which latter is re-written in step S33 in STEP 3 in FIG. 9) at $t=t_4$, the flow advances from step S42 to step S63.

It is checked in step S63 if the register RIV=1 in order to check whether or not the peaks having the same polarity are repetitively input (repetition is detected). If YES in step S63 (peaks having the same polarity are repetitively input), the flow advances to step S68 to perform repetition processing (to be described later). If NO in step S63 (repetition is not detected), the flow advances to step S64, and the following processing is executed.

In step S64, the present peak value c is input as the old peak value AMP(b), and the old amplitude value AMRL1 is input as the amplitude value AMRL2 immediately preceding the old amplitude value AMRL1 for relative-off processing (to be described later). Note that the content of AMRL1 is initially set to be "0" (step S301 in STEP 3 in FIG. 9).

Furthermore, in step S64 a larger one of the old and present peak values AMP(b) and c having opposite signs is input as the old amplitude value AMRL1. More specifically, a larger one of the two, i.e., positive and negative peak values in a period is set in the amplitude value AMRL1.

It is checked in step S65 if the waveform number counter HNC>8. The waveform number counter (zero-cross counter not at a pitch change side) HNC is incremented by 1. Therefore, the upper limit of the waveform number counter NHC is 9. After the processing in step S65 or S66, the flow advances to step S67. In step S67, the register RIV is set to be "1", the content of the time storing register TFR is subtracted from the present zero-cross time t, and the difference is input to the period register TTR. The period register TTR indicates the period data $TTR=t-TFR=t_4-t_2$ in FIG. 13. The present zero-cross time t is saved in the time storing register TFR, and thereafter, the flow returns to the processing in step M2 in the main routine of FIG. 5.

As described above, in the route , the following processing is executed according to FIG. 13. More specifically, $MT=1\neq b$, RIV=0, $AMP(0)\leftarrow c=b_2$. $AMRL2\leftarrow AMRL1=0$, $AMRL1\leftarrow \max\{AMP(1)=a_1, c=b_2$ (a larger one of them)}, $HNC\leftarrow\{HNC+1\}=1$, $RIV\leftarrow 1$, $TTR\leftarrow\{t-TFR\}=\{t_4-t_2\}$, and $TFR\leftarrow t=t_4$. Therefore, a time data difference of time data from the old zero cross time $t=t_2$ (change point from STEP 2→STEP 3) to the present zero-cross time $t=t_4$, i.e., period data is set in the period register TTR. The flow then returns to the processing in step M2 in the main routine of FIG. 5 to wait for the next peak input.

<Operation of Pitch Change Processing (Route )>

A case will be described below wherein the control advances to the route shown in steps S40 to S62. Since the waveform number counter HNC=1 (step S66), the flow advances from step S40 to step S42 (step S40 will be described later).

YES is obtained in step S42 since MT=1 and b=1 in FIG. 13, and the flow advances to step S43.

It is checked in step S43 if the register RIV =1. Since the register RIV has already been set to be "1" in the route (step S67), YES is obtained in step S43, and the flow advances to step S44. Repetition processing performed when NO is obtained in step S43 will be described later.

It is checked in step S44 if the register STEP =4. If YES in step S44, the flow advances to step S45 (a case of NO will be described later). It is checked in step S45 if the present peak value c<60H (H indicates the hexadecimal notation). If a large peak value is input, NO is obtained in step S45, and the flow advances to step S47. Contrary to this, when the input value is smaller than 60H, YES is obtained in step S45, and the flow advances to step S46.

In step S46, it is checked if {the amplitude value (peak value) AMRL2 before AMRL1}−{the old amplitude value (peak value) AMRL1}<(1/32) x {the amplitude value (peak value) AMRL2 before AMRL1}. If YES in step S46, the flow advances to step S47, and the relative-off counter FOFR is set to be "0". If NO in step S46, the flow advances to step S74, and relative-off processing is executed. The relative-off processing will be described later.

In step S48, a period calculation is made. More specifically, (present zero-cross time t−old zero-cross time data TF) is set in the register TOTO as present period value tt. The flow then advances to step 49.

In step S49, it is checked if the present period data tt>upper limit frequency THLIM (upper limit after tone generation chart). If YES in step S49, the flow advances to step S50 (a case of NO will be described later). The upper limit frequency THLIM in step S49 is the same as the upper limit of the allowable range of the frequency (i.e., corresponding to a minimum period of a tone, pitch of which is higher by 2 to 3 halftones than that of a highest tone fret) upon triggering (starting of tone generation) used in step S36 in STEP 3 in FIG. 9.

In step S50, the following processing is executed. More specifically, the register RIV is set to be "0", the present zero-cross time t is input as the old zero-cross time data TF, the old peak value AMP(b) is input as the peak value e before the old peak value AMP(b), and the present peak value c is input as the old peak value AMP(b).

After the processing in step S50, the flow advances to step S51 to check if the lower limit frequency TLLIM > the present period data tt is established. If YES in step S51, i.e., if the value of the present period becomes smaller than the value of the lower limit pitch extraction tone range during note-on (sound generation), the flow advances to step S52. In this case, the lower limit frequency TLLIM is set to be a value lower by one octave than that of an open string note. More specifically, the allowable range is widened a compared to the lower limit frequency TTLIM (step S37) in STEP 3 shown in FIG. 9. Thus, a change in frequency upon operation of a tremolo arm can be coped with.

With the above operation, when the present period falls within the range defined by the upper and lower limit frequencies, the flow advances to step S52; otherwise, the flow returns from step S49 or S51 to the processing in step M2 in the main routine shown in FIG. 5 to wait for the next peak input.

In step S52, the period data TTP is input as period data h extracted before the old period, and the present period data tt is input as the previously extracted period data TTP.

In steps S53 and S54, a "2-wave 3 value coincidence condition" is checked. In step S53, whether or not the present period data tt x $2^{-7}$ > | the present period data tt − period data h before the old period data | is checked. If YES in step S53, the flow advances to step S54. In step S54, whether or not the present period data tt x $2^{-7}$ > | the present period data tt − the content of the period register TTR | is checked. If YES in step S54, the flow advances to step S55. More specifically, for the case shown in FIG. 13, it is checked in step S53 if the present period data tt $=t_5-t_4$ (step S48) is almost equal to the old period data $h=TTP=t_3-t_1$ (step S52), and it is checked in step S54 if the present period data $tt=t_5-t_3$ is almost equal to the period $TTR=t_4-t_2$ (step S67) partially overlapping it. Note that its limit range is determined as $2^{-7}$.tt, and its value is changed depending on period data. Of course, although the limit range may be fixed, a better result can be obtained when this embodiment is employed.

In step S55, the calculation of envelope data GENV and the envelope control depending on the calculation result are executed. These processings are unusual features in the present embodiment. More specifically, the mean of the present peak value and old peak value is calculated, and the ratio of the calculated mean to the velocity VEL is calculated. Then, the ratio is used as the envelope data GENV. That is, an equation, GENV $=\{AMP(0)+AMP(1)\}/(2.VEL)$ is calculated. In FIG. 13, AMP(0) is the minimum peak value $b_2$ (absolute value) and AMP(1) is the maximum peak value $a_2$ (absolute value). Therefore, the ratio of the mean of the two above values $b_2$ and $a_2$ to the velocity VEL gives envelope data which indicates how much the present digital output $D_1$ is decreased in comparison with the initial digital output $D_1$ at the raising time. In the present embodiment, the envelope control of the musical tone described below is performed on the basis of the envelope data GENV obtained as mentioned above.

When the envelope data GENV is calculated as mentioned above, the envelope data is transferred from MCP 3 to the multiplier 6 (predetermined one of multipliers #1 to #n). The relevant multiplier 6 multiplies then musical tone data output from the musical tone generator 5 by the above envelope data GENV. The envelope dada takes a value equal to or less than the value 1 as the maximum value of the velocity VEL. The musical tone data is caused to decrease in response to the above envelope data.

When the player performs the muting operation to compulsorily cease the string vibration after plucking a string, the envelope of the string vibration abruptly decreases right after a strong attack as shown at E in FIG. 12 and thereby the envelope of the musical tone data output from the multiplier 6 can be caused to sharply decrease as shown at G in FIG. 12. Therefore, the player can change the envelope of the musical tone as the desires in accordance with his performance.

Then, in step S56 in FIG. 10, it is checked if the no-change level NCHLV > (the peak value e before the old peak value − the present peak value c) is established. If YES in step S56, the flow advances to step S57. More specifically, if the old peak value (e = AMP(b) having the same polarity and the present peak value c are largely changed, the difference therebetween exceeds NCHLV. In this case, if a pitch is changed on the basis of the extracted period data, an unnatural change in tone pitch may occur. Therefore, if NO is obtained in step S56, the flow returns to the processing in step M2 in the main routine in FIG. 5 without executing the processing in step S57 and the subsequent steps, and the following peak input is waited for.

If YES in step S56, it is checked if the relative-off counter FOFR is "0" or not. If relative-off processing (to be described later) in performed, the relative-off counter FOFR is not "0". In this case, pitch change processing (see step S61) is not executed and NO is determined in step S55. Then, the flow returns to the processing in step M2 in the main routine of FIG. 5. If YES in step S57, the flow advances to step S58.

It is checked in step S58 if the present period data tt > the constant TTU. If YES in step S58, the flow advances to step S59 to check if the present period data tt > the constant TTW. If YES in step S59, the flow advances to step S60. A case wherein NO is obtained in step S58 or S59 will be described later.

It is checked in step S60 if the register STEP = 4. If YES in step S60, the flow advances to step S61.

In step S61, the MCP 3 shown in FIG. 2 instructs the musical tone generator 5 (predetermined one of generators #1 to #n) to change a pitch (based on the present period data tt), and the flow advances to step S62.

In step S62, the time constant is changed in accordance with the present period data tt, the constant TTU is rewritten to (17/32) x the present period data tt, and the constant TTW is rewritten to (31/16) x the present period data tt.

As will be described later, only when the relative-off processing is performed, STEP = 5 is established. In this case, the flow directly advances from step S60 to step S62. Thus, the time constant is changed in step S62 without a pitch change in step S61.

The time constant change processing means that the MCP 3 shown in FIG. 2 sets period data based on the value of the present period data tt in the time constant conversion register CHTRR in the time constant conversion controller 202 shown in FIG. 3. This processing is performed as has been described in Sub-section "Detailed Operation" in Section "Operation of Pitch Extraction Digital Circut".

Upon completion of the processing in step S62, the flow returns to the processing in step M2 of the main routine shown in FIG. 5.

In the above-mentioned route , the following processing is executed in the case of FIG. 13. More specifically, it is determined that HNC=1, MT=1=b, and RIV=1. Operation FOFR←0, tt←t−TP=$t_5-t_3$, RIV←0, TF←t=$t_5$, e←AMP(1)=$a_1$, AMP(1)←c=$a_2$, h←TTP=TP(1)=$t_3-t_1$, TTP←tt=$t_5-t_3$, and GENV←{AMP(0)+AMP(1)}/(2.VEL) are performed and the GENV is sent out. Furthermore, a pitch is changed in accordance with tt when the following three conditions are satisfied:

1. TTP≈TTR≈tt
2. TTU<tt<TTW
3. AMP(0)−c<NCHLV

Thereafter, TTU←(17/32) xtt and TTN←(31/16)×tt are set.

With the above-mentioned operations, in the route , actual pitch change processing for the musical tone generator 5 (predetermined one of generators #1 to #5) is executed and also the envelope control of the output musical tone data is executed in the multiplier 6 (predetermined one of multipliers #1 to #n). Therefore, the processing of the route is executed upon the next zero-cross interruption (detection of the next peak), and similarly, the processing in the route is executed upon the next zero-cross interruption. In this manner, in the route , only a period is extracted (step S67), and in the route , actual pitch change processing (step S61), envelope control processing (step S(55) and time constant change processing (step S62) are executed.

<Relative-On Processing Operation>

After the waveform number counter HNC is counted up to exceed 3 in step S66 in the route in STEP 4 in FIG. 10, YES is determined in step S40, and the flow advances to step S41 to detect a "relative-on condition".

This case occurs when c−AMP(b)>TRLRL, i.e., the present peak value c is increased to exceed the threshold value TRLRL as compared to the old peak value AMP(b). That is, this case occurs when a given string is plucked immediately after it was plucked (by, e.g., tremolo operation). In this case, YES is obtained instep S41, and the flow advances from step S41 to step S78 to execute the relative-on processing.

In step S78, the period CHTIM of the highest note fret (e.g., 22nd fret) is set in the time constant conversion register of the time constant conversion controller 202 (FIG. 3).

After the above processing, the flow advances to step S06 in STEP 0 in FIG. 6, a musical tone which is being produced is rendered note-off, and its tone generation is restarted. Accordingly to a normal performance operation, NO is determined in step S41 in STEP 4 in FIG. 10, and the flow advances to step S42. Thereafter, the control advances to the route or .

<Relative-Off Processing Operation>

Figure 17:
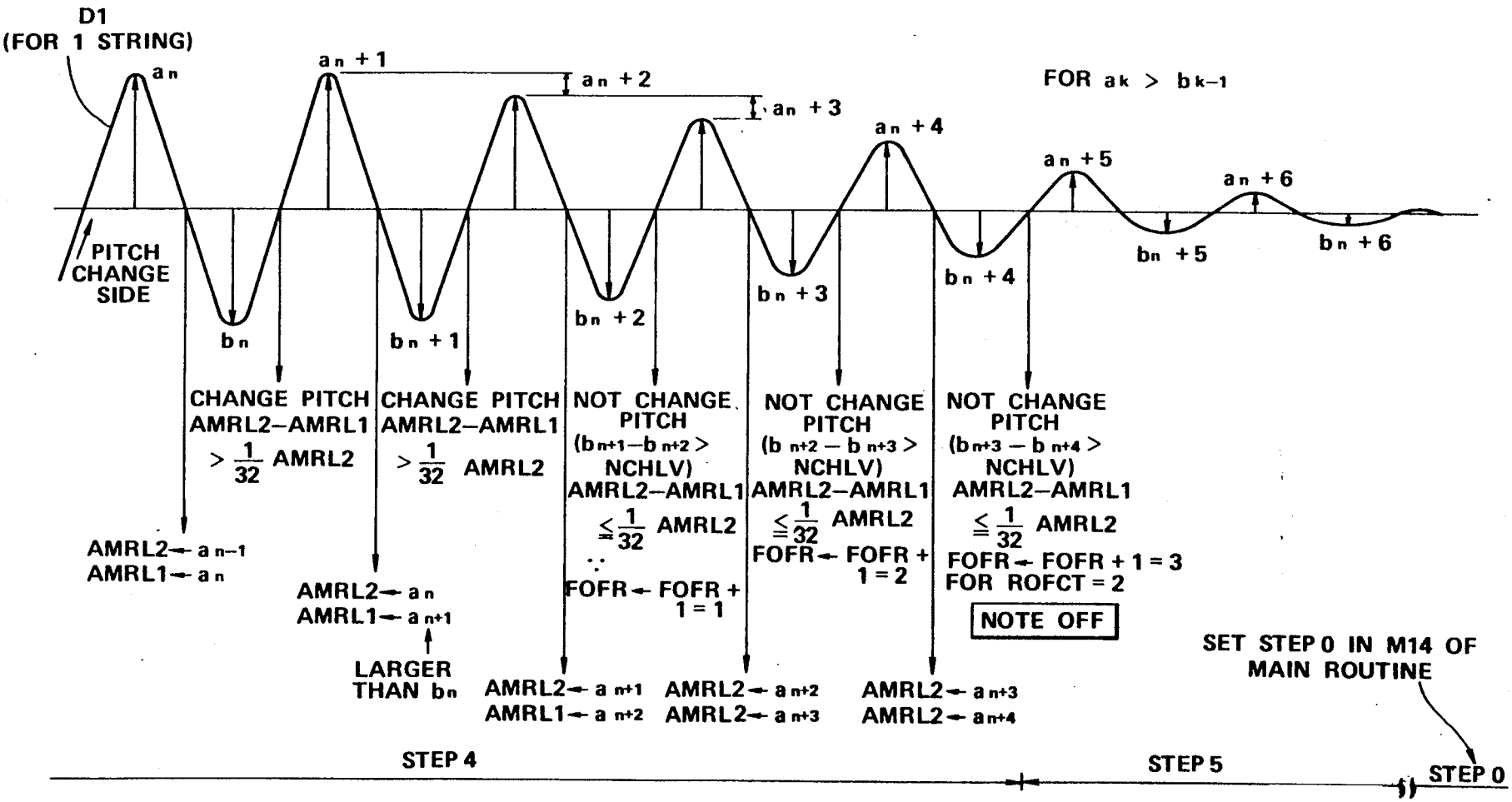
FIG. 17 a chart for explaining relative-off processing in STEP 4.

Relative-off processing will be described below with reference to FIG. 17. In "relative-off" processing, a note-off operation is performed when a state wherein the fret operation is performed transits to an open string state without plucking the corresponding string.

In this case, the amplitude level of the waveform immediately falls, and a difference between the peak value AMRL2 before the old peak value and the old peak value AMRL1 exceeds (1/32) AMRL2. Thus, the flow advances from step S46 in STEP 4 to step S74 in FIG. 10.

The flow then advances from step S74 to step S75 to count up until the relative-off counter FOFR exceed the constant ROFCT.

Subsequently, the flow advances from step S75 to step S48 and processing in steps S49 to S55 is executed. However, since FOFR =0 is not established, NO is obtained in step S57, and the flow returns to the processing in step M2 in the main routine of FIG. 5 without performing pitch change processing immediate before the relative-off processing.

In the route mentioned above, the calculation of the envelope data GENV is executed in step S55 and the envelope control of a musical tone is effected based on the calculated envelope data. Therefore, even in case that the envelope of the digital output D1 abruptly decreases in the course of the relative-off, the multiplier 6 of FIG. 2 executes the envelope control of the musical tone on the basis of the envelope data in the manner as mentioned above, and thereby the envelope of the musical tone can be changed in response to the relative off.

Peaks in a relative-off state are sequentially input, and NO is obtained in step S74. That is, if the value of the counter FOFR becomes 3 in FIG. 17 (ROFCT =2), the flow advances from step S74 to step S76.

Once YES is obtained in step S46, the flow advances from step S46 to step S47, and counter FOFR is rest. Therefore, unless the condition in step S46 is kept satisfied the number of times designated by the constant ROFCT, the relative-off processing is not executed. Note that as the value ROFCT, a larger value is assigned to a string having a higher pitch, so that relative-off processing can be performed for any string after the lapse of an almost predetermined period of time.

The flow then advances from step S74 to step S76. In step S76, the relative-off counter FOFR is reset, and the register STEP is set to be 5. The flow advances to step S77, and the musical tone generator 5 (predetermined of generators #1 to #n) is instructed to perform note-off.

When the register STEP=5, the pitch extraction processing is executed in the same manner as in STEP 4. However, since the flow advances from step S60 to step S62 without going through step S61, the musical tone generator 5 is not instructed to change a pitch. However, the MCP3 performs the time constant change processing in accordance with the period extracted in step S62.

When the register STEP=5, the relative-on processing is accepted (S41 and S78). In other cases, since a decrease in vibration level is detected in the main routine shown in FIG. 5, the register STEP is set to be "0" in step M14, and an initial state is set.

Note that AMRL1 and AMRL2 used instep S46 are formed in step S64, and a peak (one of maximum and minimum peaks) having a higher level in a period is determined as this value. A maximum peak ak in FIG. 17 is always higher than a minimum peak bk−1, and all differences between an+1 and an+2, an+2 and an+3, and an+3 and an+4 exceed a predetermined value.

In the processing of the route , since the minimum peaks bn+1, bn+2, and bn+3 are extremely decreased, NO is achieved in step S54. The flow then returns to the processing in step M2 of the main routine shown in FIG. 5, and the pitch change processing is not executed.

<Processing Operation When Pitch Period is Inappropriate>

Processing when a pitch period is inappropriate, that is, when overtones in an octave relationship, i.e., periods having tone pitches higher or lower by an octave are successively detected in steps S58 and S59 during pitch extraction will be described below.

The constant TTU used in step S58 in STEP 4 of FIG. 10 is set to be a minimum value "0" in step S301 in STEP 3 of FIG. 9, and the constant TTW is similarly set to be a maximum value MAX. When this flow is executed for the first time, YES is always determined in both steps S58 and S59. Thereafter, in step S62, (17/32).tt (period data having a tone pitch higher by almost one octave) is set as the constant TTU, and similarly, (31/16).tt (period data having a tone pitch lower by almost one octave) is set as the constant TTW.

Therefore, when the tone pitch is immediately increased by an octave (this is caused when a mute operation is performed to stop a vibration of a string with a finger) or when the tone pitch is immediately decreased by an octave (this is caused when the peak of the waveform fails to detect), if a pitch is changed, the resultant tone sounds unnatural. Thus, the flow branches so as not to execute pitch change processing.

More specifically, if tt does not exceed TTU, i.e., tt becomes smaller than the value TTU obtained by multiplying 17/32 with the previously extracted period in step S58, the flow advances to step S76. When a tone higher by an octave is extracted, it is determined that a mute operation is performed, and the flow advances from step S58 to step S76 without outputting a tone higher by an octave, and generation of the corresponding tone is stopped by the processing in steps S76 and S77 in the same manner as in the relative-off processing already explained.

If tt does nct exceed TTW, i.e., tt does not become larger than the value TTW obtained by multiplying 31/16 with the previously extracted period is step S59, the flow returns to the processing in step M2 of the main routine shown in FIG. 5 without advancing to step S60.

Figure 18:
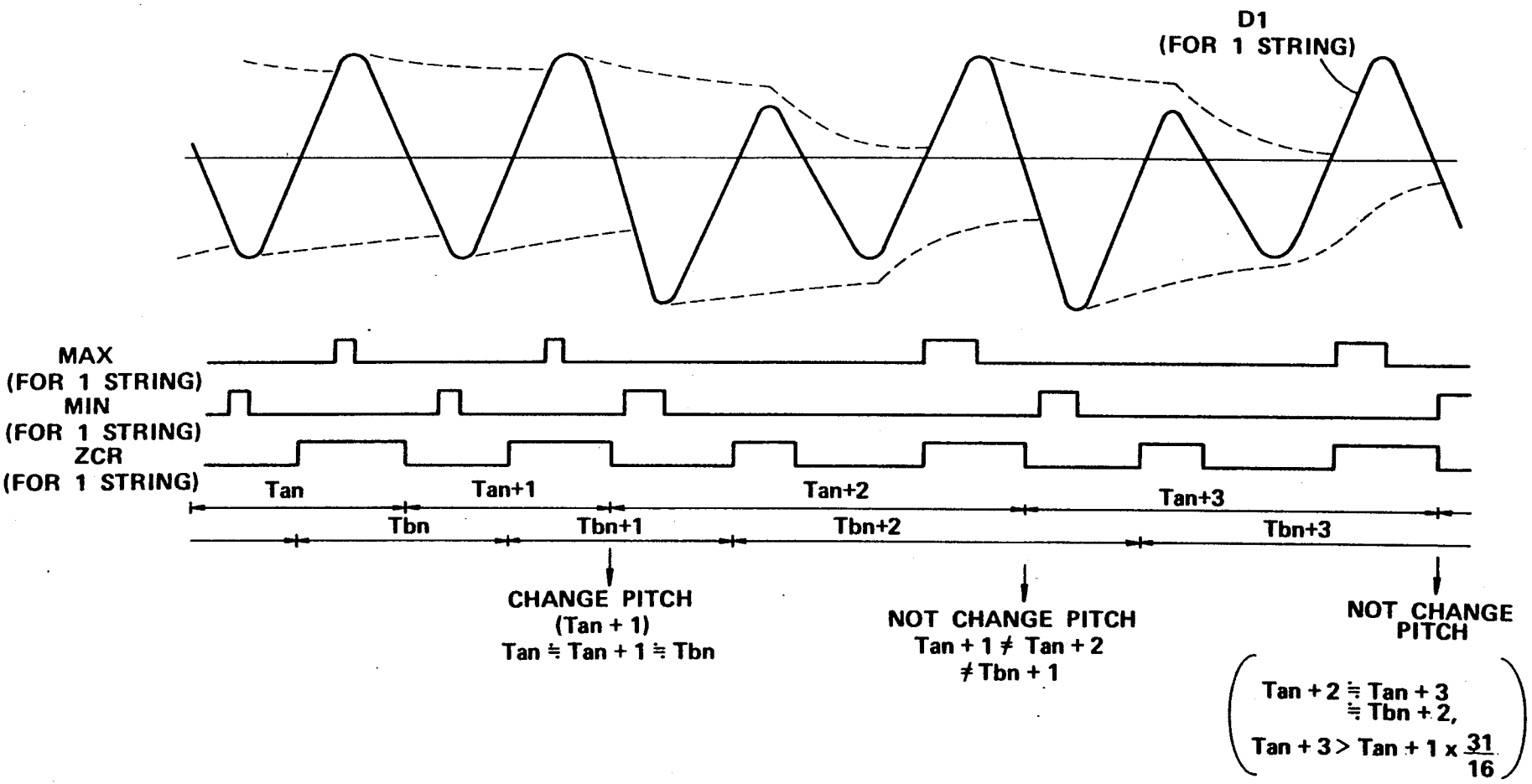
FIG. 18 is a chart for explaining a processing operation when a detected pitch is inappropriate in STEP 4.

This state is shown in FIG. 18. When a waveform is as small as note-off, another waveform is superposed due to a crosstalk of the hexa pickup or a resonance of a body caused by plucking operation of other strings. Thus, the input waveform becomes as shown in FIG. 18, and an input waveform below one octave may be successively detected.

In this state, if no processing is performed, a tone below one octave is generated, thereby resulting in very unnatural tone generation. For this reason, even if $Tan+2 \approx Tan+3 \approx Tbn+2$ is detected in steps S56 and S57, since $Tan+3 > Tan+1 \times (31/16)$, the flow returns from step S59 to the processing in step M2 in the main routine shown in FIG. 5 without changing a pitch.

<Repetition Processing Operation>

Processing to be executed when waveforms are repetitively extracted, i.e., when peaks having the same polarity are successively detected will now be described.

In the route wherein NO is obtained in step S42 in STEP 4 in FIG. 10, if YES is obtained in step S63, the flow advances to step S68 to execute the repetition processing.

More specifically, if YES in step S63, the flow advances to step S68 to check if the present peak value c>the old peak value AMP(b) having the same sign. If YES in step S68, the flow advances to step S69.

In step S69, the old peak value AMP(b) is rewritten to the present peak value c, and the flow advances to step S70.

It is checked in step S70 if the present peak value c>the old amplitude value (peak value) AMRL1. If YES in step S70, the flow advances to step S71. In step S71, the present peak value c is set as the old amplitude value (peak value) AMRL1.

If NO is determined in step S68, the flow immediately returns to the processing in step M2 of the main routine shown in FIG. 5. Therefore, only when the peak of a new input wave is high, it can be determined that the peak of an overtone is not picked up. Therefore, the peak value of the new waveform is registered.

If NO in step S70 and if the processing in step S71 is completed, the control similarly returns to the main routine.

Figure 19:
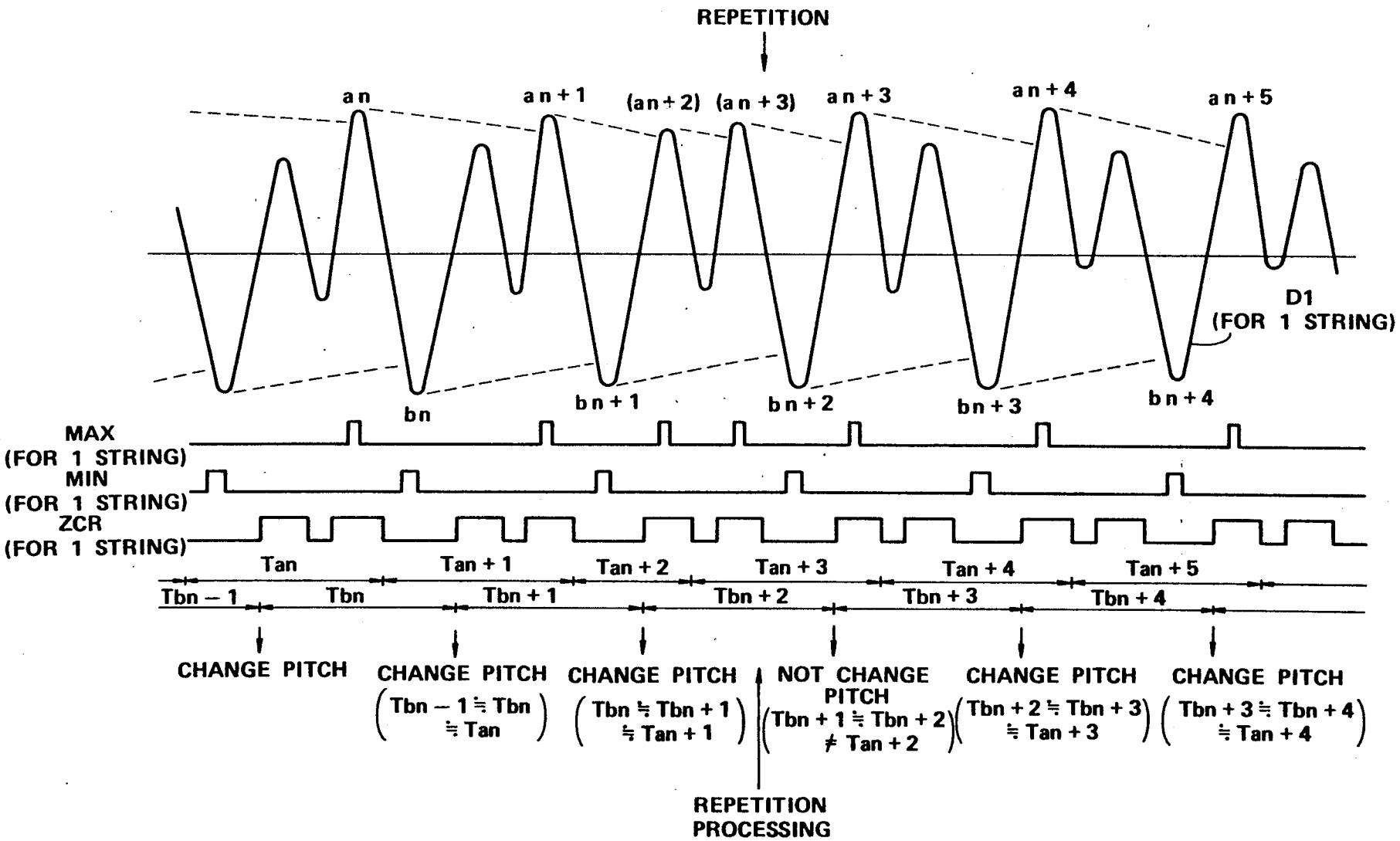
FIG. 19 is a chart for explaining repetition processing in a route.

FIG. 19 shows the repetition processing. In this case, MT=0. In general, since the fundamental wave period has a non-integer multiple relationship with the period of an overtone component, the phase of the overtone is gradually shifted, and a zero-cross point having the same polarity may be accidentally detected. Therefore, erroneous pitch change processing caused by the above detection must be prevented. In FIG. 19, a repetition state occurs at a position indicated by "repetition". In this case, the flow advances from step S42 to step S63. YES is determined in step S63, and the flow advances to step S68. In this case, (an+2) is compared with (an+3) in step S68. Only when (an+3) is larger than (an+2), the flow advances to step S69, and AMP(1) is updated. The old amplitude value (peak value) AMRL1 is compared with the present amplitude value (peak value c) in step S70. If YES in step S70, the flow advances to step S71, and the present peak value c is set as the old amplitude value (peak value) AMRL1.

In the route wherein YES is obtained in step S42 in STEP 4 in FIG. 10, if NO is obtained in step S43, the flow advances to step S72, and the repetition processing is executed in the same manner as described above.

More specifically, if NO in step S43, the flow advances to step S72 to check if the present peak value c>the old peak value AMP(b) having the same sign. If YES in step S72, the flow advances to step S73, and the old peak value AMP(b) is written to the present peak value c. Thereafter, the flow returns to the processing in step M2 of the main routine shown in FIG. 5.

If NO in step S72, the flow returns to the processing in step M2 of the main routine shown in FIG. 5. In this case, only when the peak of a new input wave is high, the peak value of the new waveform is registered.

Figure 20:
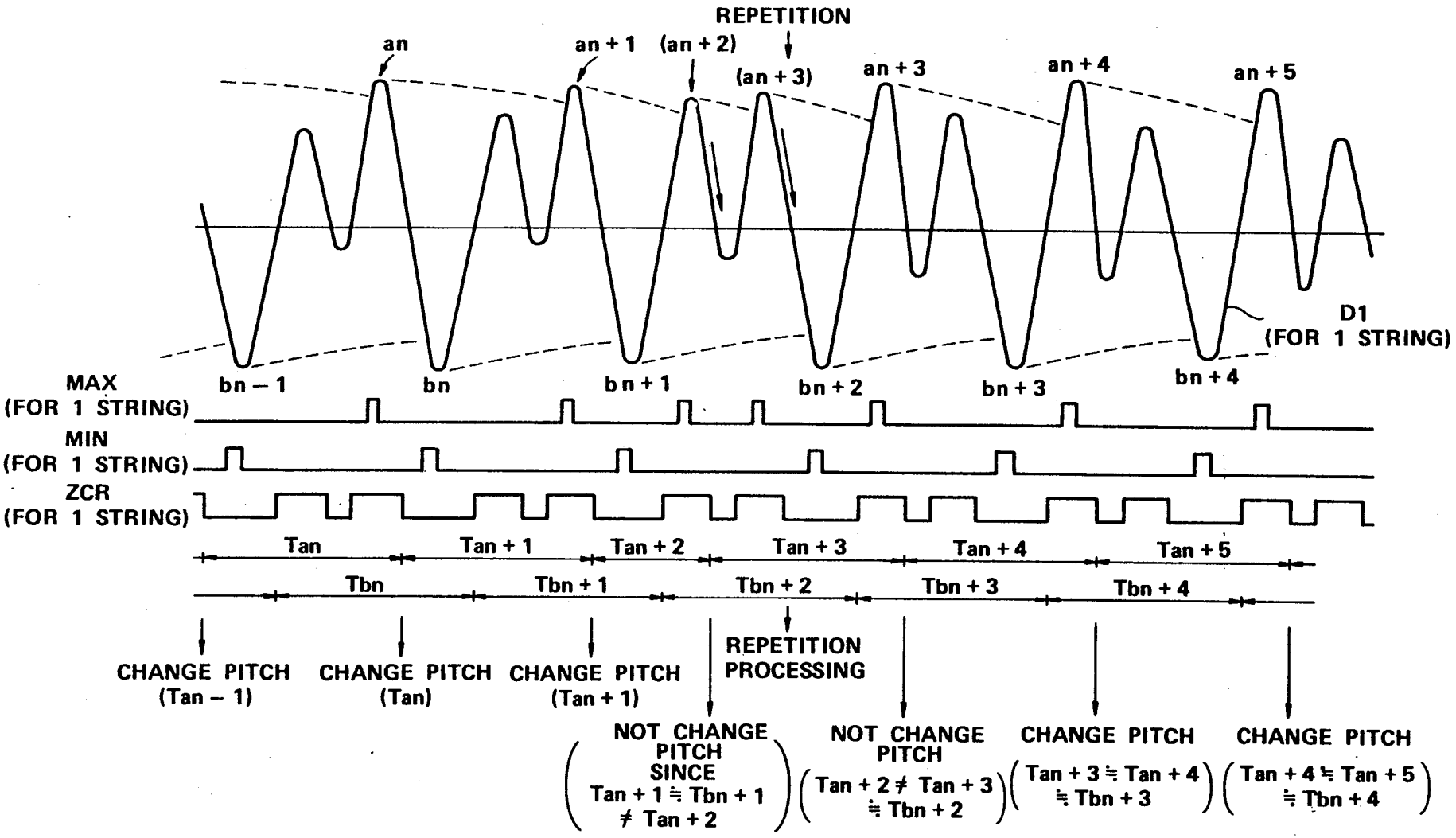
FIG. 20 is a chart for explaining repetition processing in a route .

FIG. 20 shows this case. In this case, MT=1. In the processing of STEP 4 at the zero-cross point indicated by "repetition" in FIG. 20, the flow advances from step S42 to step S43. YES is obtained in step S43, and the flow advances to step S72. In this case, (an+3) is compared with (an+2) in step S72. If (an+3) is larger than (an+2), YES is determined in step S72, and (an+3) is set in AMP(1); otherwise, no change processing is executed.

In the repetition processing, extracted time data is not used. Therefore, period data Tan+3 is left unchanged. Pitch change processing based on the period data is not executed, either.

{Other Embodiments of the Present Invention}

As described above, in this embodiment, the average value of the peak valve at every timing and the preceding or old peak value is calculated and the musical tone data is multiplied by the ratio of the calculated average value to the velocity at the leading edge of the waveform as the envelope data. In this manner, the envelope is prevented from unnaturally changing due to the variation (sway) of the peak value and the level difference between the positive peak and the negative peak is rectified. However, the present invention is not limited to this. The peak value at every timing can be used without being modified. In this case, in step S55 in FIG. 10, the following processing is executed: GENV←AMP(1)/VEL or GENV←AMP(0)/VEL. Furthermore, in other case, running averages of three and more peak values or averages having a hysteresis characteristic can be used.

In the embodiment, the musical tone data output from the musical tone generator is multiplied by the envelope data by the multiplier and thereby the envelope of the musical tone is controlled. However, the envelope data can be input to the musical tone generator to directly control the same. Any of a digital multiplication and an analog multiplication can be employed for the envelope multiplication.

In the above embodiment, the present invention is applied to an electronic guitar in which a pitch is extracted from the waveform of the string vibration and thereby a musical tone is controlled. However, the present invention is not limited to this. The present invention can be applied to any type of electronic musical instruments in which an envelope is extracted from the input waveform signal to control the musical tone to be generated. The present invention is not limited to an application to the electronic musical instrument in which the pitch is extracted from the input waveform signal.

Furthermore, not only the envelope of tone volume of the musical tone but the envelope of the timbre variation can be controlled. In this case, an envelope of each spectrum component is extracted and the level of each component can be controlled to change in accordance with the extracted envelope in the same manner as described in the embodiment.

According to the present invention, in the electronic musical instrument in which the musical tone generating means is controlled on the basis of the input waveform signal and thereby a musical tone corresponding to the input waveform is artificially produced, the envelope of the input waveform signal is used to reflect the envelope of the musical tone. Therefore, appropriate performance effects can be obtained by use of the envelope of the input waveform signal. Thus, it is possible to add the effect of the envelope of the input waveform signal to the inherent envelope effect of the musical tone. It is also possible to impart the envelope effect of the input waveform signal directly to a musical tone waveform having a normalized level.

Accordingly, for example, in an electronic guitar, when the player performs the muting operation to compulsorily cease the string vibration after plucking a string, the envelope of the string vibration abruptly decreases immediately after a strong attack. Therefore, the envelope of a musical tone output from the envelope control means can be abruptly decreased. Thus, the player can naturally change the envelope of a musical tone as he expects by his operation.

What is claimed is:

1. An electronic musical instrument, comprising:

envelope extraction means for extracting an envelope signal from an input waveform signal;

means for digitizing said input waveform signal to produce a digital waveform signal;

musical tone generation means for generating a musical signal; and envelope control means for imparting the envelope signal extracted by said envelope extraction means to the musical tone signal generated by said musical tone generation means; and wherein said envelope extraction means comprises:

maximum peak value detection means for detecting a maximum peak value of said digital waveform signal at the leading edge, said digital waveform signal being obtained by said digitizing of said input waveform signal;

effective peak value detection means for sequentially detecting effective peak values of said digital waveform signal after its leading edge; and envelope signal calculation means including means for calculating average values of present effective peak values detected sequentially by said effective peak value detection means and previous effective peak value; means for sequentially calculating ratios of the average values to the maximum peak value detected by said maximum peak value detection means; and means for sequentially outputting the calculated ratios as the envelope signal; and wherein said envelope control means comprises multiplication means for multiplying the musical tone signal generated by said musical tone generation means by the envelope signal output by said envelope signal calculation means.

2. An electronic musical instrument, comprising:

envelope extraction means for extracting an envelope signal from an input waveform signal;

means for digitizing said input waveform signal to produce a digital waveform signal;

musical tone generation means for generating a musical tone signal; and envelope control means for imparting the envelope signal extracted by said envelope extraction means to the musical tone signal generated by said musical tone generation means; and wherein said envelope extraction means comprises:

maximum peak value detection means for detecting a maximum peak value of said digital waveform signal at its leading edge, said digital waveform signal being obtained by said digitizing of said input waveform signal;

effective peak value detection means for sequentially detecting effective peak values of said digital waveform signal after its leading edge; and envelope signal calculation means including means for sequentially calculating ratios of the present peak effective values detected sequentially by said effective peak value detection means to the maximum peak value detected by said maximum peak value detection means; and means for sequentially outputting the calculated ratios as the envelope signal; and wherein said envelope control means comprises multiplication means for multiplying the musical tone signal generated by said musical tone generation means by the envelope signal output by said envelope signal calculation means.

3. An electronic stringed instrument, in which a pitch is detected from an extracted string vibration and a musical tone having a corresponding tone pitch is generated, comprising:

musical tone generation means for generating a musical tone having the tone pitch;

envelope extraction means for extracting an envelope signal of the string vibration; and envelope control means for imparting the envelope signal extracted by said envelope extraction means to the musical tone generated by said musical tone generation means, thereby generating a musical tone having an envelope represented by the envelope signal extracted by said envelope extraction means; and wherein said envelope extraction means comprises:

digital signal generation means for generating a digital signal expressing the string vibration;

maximum peak value detection means for detecting a maximum peak value, at the leading edge, of the digital signal supplied from said digital signal generation means;

effective peak value detection means for sequentially detecting effective peak values of the digital signal after its leading edge; and calculation means for calculating ratios of the effective peak values sequentially detected by said effective peak value detection means to the maximum peak value previously detected by said maximum peak value detection means, thereby obtaining the envelope signal of said string vibration.

4. An electronic musical instrument, comprising:

envelope extraction means for extracting an envelope signal from an input waveform signal;

means for digitizing said input waveform signal to produce a digital waveform signal;

musical tone generation means for generating a musical tone signal; and envelope control means coupled to said envelope extraction means and to said musical tone generation means for controlling an envelope of the musical tone signal supplied from the musical tone generation means in accordance with the envelope signal extracted by said envelope extraction means; and wherein said envelope extraction means comprises:

maximum peak value detection means for detecting a maximum peak value of said digital waveform signal at its leading edge, said digital waveform signal being obtained by said digitizing of said input waveform signal;

effective peak value detection means for sequentially detecting effective peak values of said digital waveform signal after its leading edge; and envelope signal calculation means including means for calculating average values of present effective peak values detected sequentially by said effective peak value detection means and previous effective peak values; means for sequentially calculating ratios of the average values to the maximum peak value detected by said maximum peak value detection means; and means for sequentially outputting the calculated ratios as the envelope signal.

5. An electronic musical instrument, comprising:

envelope extraction means for extracting an envelope signal from an input waveform signal;

means for digitizing said input waveform signal to produce a digital waveform signal;

musical tone generation means for generating a musical tone signal; and envelope control means coupled to said envelope extraction means and to said musical tone generation means for controlling an envelope of the musical tone signal supplied from the musical tone generation means in accordance with the envelope signal extracted by said envelope extraction means; and wherein said envelope extraction means comprises:

maximum peak value detection means for detecting a maximum peak value of said digital waveform signal at its leading edge, said digital waveform signal being obtained by said digitizing of said input waveform signal;

effective peak value detection means for sequentially detecting effective peak values of said digital waveform signal after its leading edge; and envelope signal calculation means including means for sequentially calculating ratios of present effective peak values detected sequentially by said effective peak value detection means to the maximum peak value detected by said maximum peak value detection means; and means for sequentially outputting the calculated ratios as the envelope signal.

6. An electronic musical instrument in which pitch data is extracted from an input waveform signal, and a musical tone having a corresponding tone pitch is generated, comprising:

means for digitizing said input waveform signal to produce a digital waveform signal;

pitch extraction means for extracting pitch data from the input waveform signal;

musical tone generation means for generating a musical tone having a tone pitch designated in accordance with the pitch data extracted by said pitch extraction means;

envelope extraction means for extracting an envelope signal from the input waveform signal in real time; and envelope control means for imparting the envelope signal extracted by said envelope extraction means to the musical tone generated by said musical tone generation means, thereby generating a musical tone having a controlled envelope; and wherein said envelope extraction means comprises:

maximum peak value detection means for detecting a maximum peak value of said digital waveform signal at its leading edge, said digital waveform signal being obtained by said digitizing of said input waveform signal;

effective peak value detection means for sequentially detecting effective peak values of said digital waveform signal after its leading edge; and envelope signal calculation means including means for calculating average values of present effective peak values detected sequentially by said effective peak value detection means and previous effective peak values, means for sequentially calculating ratios of the average values to the maximum peak value detected by said maximum peak value detection means, and means for sequentially outputting the calculated ratios as the envelope signal.

7. An electronic musical instrument in which pitch data is extracted from an input waveform signal, and a musical tone having a corresponding tone pitch is generated, comprising:

means for digitizing said input waveform signal to produce a digital waveform signal;

pitch extraction means for extracting pitch data from the input waveform signal;

musical tone generation means for generating a musical tone having a tone pitch designated in accordance with the pitch data extracted by said pitch extraction means;

envelope extraction means for extracting an envelope signal from the input waveform signal in real time; and envelope control means for imparting the envelope signal extracted by said envelope extraction means to the musical tone generated by said musical tone generation means, thereby generating a musical tone having a controlled envelope; and wherein said envelope extraction means comprises:

maximum peak value detection means for detecting a maximum peak value of said digital waveform signal at its leading edge, said digital waveform signal being obtained by said digitizing of said input waveform signal;

effective peak value detection means for sequentially detecting effective peak values of said digital waveform signal after its leading edge; and envelope signal calculation means including means for calculating ratios of present effective peak values detected sequentially by said effective peak value detection means to the maximum peak value detected by said maximum peak value detection means; and means for sequentially outputting the calculated ratios as the envelope signal.

8. An electronic stringed instrument, comprising:

a plurality of strings;

sensor means provided corresponding to said strings, for sensing a string vibration and for providing an electrical signal representing the string vibration;

pitch extraction means for extracting a pitch of the string vibration for each string, from the electrical signal representing the string vibration and provided by said sensor means;

musical tone production means for producing a musical tone, for each string, said musical tone for each string having a corresponding tone pitch in accordance with the pitch extracted by said pitch extraction means;

envelope extraction means for extracting an envelope signal, for each string, expressing the envelope of the string vibration from the electrical signal provided by said sensor means;

envelope control means for multiplying the musical tone signal for each string supplied from said musical tone production means by the envelope signal for each string supplied from said envelope extraction means, thereby obtaining a musical tone signal for each string, having a controlled envelope; and means for digitizing said electrical signal for each string to produce a digital waveform signal; and wherein said envelope extraction means comprises:

maximum peak value detection means for detecting a maximum peak value of said digital waveform signal at its leading edge, said digital waveform signal being obtained by said digitizing of said input signal for each string;

effective peak value detection means for sequentially detecting effective peak values of said digital waveform signal after its leading edge; and envelope signal calculation means including means for calculating average values of present effective peak values detected sequentially by said effective peak value detection means and previous effective peak values, means for sequentially calculating ratios of the average values to the maximum peak value detected by said maximum peak value detection means; and means for sequentially outputting the calculated ratios as the envelope signal.

9. An electronic stringed instrument, comprising:

a plurality of strings;

sensor means provided corresponding to said strings, for sensing a string vibration and for providing an electrical signal representing the string vibration;

pitch extraction means for extracting a pitch of the string vibration for each string, from the electrical signal representing the string vibration and provided by said sensor means;

musical tone production means for producing a musical tone, for each string, said musical tone for each string having a corresponding tone pitch in accordance with the pitch extracted by said pitch extraction means;

envelope extraction means for extracting an envelope signal, for each string, expressing the envelope of the string vibration from the electrical signal provided by said sensor means;

envelope control means for multiplying the musical tone signal for each string supplied from said musical tone production means by the envelope signal for each string supplied from said envelope extraction means, thereby obtaining a musical tone signal for each string, having a controlled envelope; and means for digitizing said electrical signal for each string to produce a digital waveform signal; and wherein said envelope extraction means comprises:

maximum peak value detection means for detecting a maximum peak value of said digital waveform signal at its leading edge, said digital waveform signal being obtained by said digitizing of said input signal for each string;

effective peak value detection means for sequentially detecting effective peak values of said digital waveform signal after its leading edge; and envelope signal calculation means including means for calculating ratios of present effective peak values detected sequentially by said effective peak value detection means to the maximum peak value detected by said maximum peak value detection means, and means for sequentially outputting the calculated ratios as the envelope signal.

* * * * *

UNITED STATES PATENT AND TRADEMARK OFFICE

CERTIFICATE OF CORRECTION

PATENT NO. : 5,048,391

DATED : September 17, 1991

INVENTOR(S) : UCHIYAMA et al

It is certified that error appears in the above-identified patent and that said Letters Patent is hereby corrected as shown below:

Column 36, line 57 (claim 2), change "said" to read --the--.

Column 36, lines 60-61 (claim 2), change "ratios of the present peak effective values" to read --ratios of present effective peak values--.

Column 40, line 7 (claim 8), change "input signal" to read --electrical signal--.

Column 40, line 51 (claim 9), change "input signal" to read --electrical signal--.

Signed and Sealed this

Thirteenth Day of April, 1993

*Attest:*

STEPHEN G. KUNIN

*Attesting Officer*

*Acting Commissioner of Patents and Trademarks*